US008528950B2

(12) United States Patent
Organek et al.

(10) Patent No.: US 8,528,950 B2
(45) Date of Patent: Sep. 10, 2013

(54) LATCH MECHANISM AND LATCHING METHOD

(75) Inventors: Gregory J. Organek, Whitefish Bay, WI (US); Steven J. Dimig, Plymouth, WI (US); Mark S. Paulson, Oak Creek, WI (US); Kyle J. Beutin, Oak Creek, WI (US)

(73) Assignee: Strattec Security Corporation, Milwaukee, WI (US)

( * ) Notice: Subject to any disclaimer, the term of this patent is extended or adjusted under 35 U.S.C. 154(b) by 0 days.

(21) Appl. No.: 13/575,891

(22) PCT Filed: Feb. 1, 2011

(86) PCT No.: PCT/US2011/023324

§ 371 (c)(1),
(2), (4) Date: Jul. 27, 2012

(87) PCT Pub. No.: WO2011/094736

PCT Pub. Date: Aug. 4, 2011

(65) Prior Publication Data

US 2012/0299313 A1 Nov. 29, 2012

Related U.S. Application Data

(60) Provisional application No. 61/337,222, filed on Feb. 1, 2010, provisional application No. 61/353,720, filed on Jun. 11, 2010.

(51) Int. Cl.
*E05C 3/06* (2006.01)
*E05C 9/00* (2006.01)

(52) U.S. Cl.
USPC ..... 292/216; 292/23

(58) Field of Classification Search
USPC ..... 292/23, 201, 216
See application file for complete search history.

(56) References Cited

U.S. PATENT DOCUMENTS

| | | | | |
|---|---|---|---|---|
| 2,646,299 | A | 7/1953 | Kramer | |
| 2,679,428 | A * | 5/1954 | Rop | 292/332 |
| 2,758,862 | A | 8/1956 | Endter | |
| 2,767,007 | A * | 10/1956 | Burke | 292/216 |
| 2,881,021 | A | 4/1959 | Jacobson | |
| 3,236,551 | A | 2/1966 | Nash | |
| 3,695,662 | A | 10/1972 | Ploughman | |
| 3,809,416 | A | 5/1974 | Kazoaka | |

(Continued)

OTHER PUBLICATIONS

International Search Report and Written Opinion for Application No. PCT/US2011/023324 dated Mar. 28, 2011 (7 pages).

(Continued)

*Primary Examiner* — Carlos Lugo
(74) *Attorney, Agent, or Firm* — Michael Best & Friedrich LLP

(57) ABSTRACT

A latch includes a catch pivotable about a first axis between a latched position for retaining a striker and an unlatched position for releasing the striker. The catch has a cam surface. A pawl is pivotable about a second axis and is engageable with the cam surface of the catch. In some embodiments, the pawl secures the catch in the latched position by resting on a first portion of the cam surface, the curvature of which is substantially concentric with the second axis when the catch is in the latched position. The pawl is movable off of the first portion of the cam surface to release the catch from the latched position. The catch can be drivable toward the latched position by the pawl.

28 Claims, 17 Drawing Sheets

(56) References Cited

U.S. PATENT DOCUMENTS

| | | | | |
|---|---|---|---|---|
| 3,917,330 | A | | 11/1975 | Quantz |
| 4,258,945 | A | | 3/1981 | Pouget |
| 4,627,649 | A | * | 12/1986 | Leplat ..... 292/92 |
| 4,906,035 | A | | 3/1990 | Nagai et al. |
| 4,971,373 | A | | 11/1990 | Hamada et al. |
| 5,022,698 | A | | 6/1991 | Butt et al. |
| 5,118,146 | A | | 6/1992 | Watanuki |
| 5,137,311 | A | * | 8/1992 | Brackmann ..... 292/216 |
| 5,595,407 | A | * | 1/1997 | ter Horst et al. ..... 292/5 |
| 5,611,600 | A | | 3/1997 | Busch et al. |
| 5,722,727 | A | | 3/1998 | Unckrich |
| 5,735,557 | A | * | 4/1998 | Harvey ..... 292/216 |
| 5,904,403 | A | | 5/1999 | Unckrich |
| 6,109,079 | A | | 8/2000 | Ikeda |
| 6,158,788 | A | | 12/2000 | Ikeda et al. |
| 6,286,878 | B1 | | 9/2001 | Hochart et al. |
| 6,386,599 | B1 | | 5/2002 | Chevalier |
| 6,464,298 | B1 | | 10/2002 | Hänsel et al. |
| 6,540,232 | B2 | | 4/2003 | Hänsel et al. |
| 6,540,271 | B1 | | 4/2003 | Kalsi |
| 6,719,333 | B2 | | 4/2004 | Rice et al. |
| 6,749,234 | B2 | | 6/2004 | Bruce |
| 6,773,042 | B2 | | 8/2004 | Spurr et al. |
| 6,817,636 | B1 | | 11/2004 | Evans et al. |
| 6,883,839 | B2 | | 4/2005 | Belmond et al. |
| 6,948,745 | B2 | | 9/2005 | Chevalier |
| 6,953,232 | B2 | | 10/2005 | Busby et al. |
| 7,044,552 | B2 | | 5/2006 | Müller et al. |
| 7,111,878 | B2 | | 9/2006 | Kachouh |
| 7,125,057 | B2 | | 10/2006 | Coleman et al. |
| 7,210,714 | B2 | | 5/2007 | Berghahn et al. |
| 7,261,336 | B2 | | 8/2007 | Zillert |
| 7,261,338 | B2 | | 8/2007 | Spurr |
| 7,261,339 | B2 | | 8/2007 | Kiehl |
| 7,287,814 | B2 | | 10/2007 | Heimann et al. |
| 7,311,330 | B2 | | 12/2007 | Kachouh |
| 7,325,843 | B2 | | 2/2008 | Coleman et al. |
| 7,360,803 | B2 | * | 4/2008 | Parent et al. ..... 292/216 |
| 7,413,225 | B2 | | 8/2008 | Spurr |
| 7,434,852 | B2 | | 10/2008 | Spurr |
| 7,475,923 | B2 | | 1/2009 | Ottino et al. |
| 2003/0178859 | A1 | | 9/2003 | Belmond et al. |
| 2005/0200137 | A1 | | 9/2005 | Nelsen et al. |
| 2005/0212302 | A1 | | 9/2005 | Fisher |
| 2006/0220393 | A1 | | 10/2006 | Dimig et al. |
| 2006/0267351 | A1 | | 11/2006 | Spurr |
| 2007/0200357 | A1 | | 8/2007 | Westerwick et al. |
| 2007/0257496 | A1 | | 11/2007 | Spurr et al. |
| 2009/0160198 | A1 | | 6/2009 | Yoda |
| 2009/0199605 | A1 | | 8/2009 | Spurr et al. |
| 2010/0066103 | A1 | | 3/2010 | Sauri et al. |

OTHER PUBLICATIONS

International Preliminary Report on Patentability for Application No. PCT/US2011/023324 dated May 17, 2012 (3 pages).

* cited by examiner

LATCH MECHANISM AND LATCHING METHOD

CROSS-REFERENCE TO RELATED APPLICATIONS

This application claims priority to U.S. Provisional Patent Application No. 61/337,222, filed Feb. 1, 2010, and to U.S. Provisional Patent Application No. 61/353,720, filed Jun. 11, 2010, the entire contents of both of which are incorporated by reference herein.

BACKGROUND

The present invention relates to latch mechanisms, such as those used in automotive applications including, but not limited to, vehicular rear hatches, trunks, and doors.

SUMMARY

In some embodiments, the invention provides a latch releasably engagable with a striker having a trajectory defined between a latched position and an unlatched position. A catch is pivotable about a first axis and has first and second grooves, and a pawl is pivotable about a second axis that can be parallel to the first axis. The first groove of the catch is positioned to releasably receive the striker, and the second groove of the catch is positioned to receive a portion of the pawl. When, for example, the latch is driven to a latched state in a cinching operation, the portion of the pawl can cam across an interior surface of the second groove to rotatably drive the catch to a latched position. Alternatively or in addition, when the latch is released and the catch is rotated toward an unlatched position under the bias of a catch spring and/or the striker, the portion of the pawl can cam across the interior surface of the second groove as the catch is rotated toward the unlatched position. When, for example, the latch is powered to an unlatched state by a motor driving the pawl or under the bias of a pawl spring, the portion of the pawl can cam across another interior surface of the second groove to rotatably drive the catch toward an unlatched position. Alternative or in addition, when the striker drives the catch to rotate the catch toward a latched position, this other interior surface of the second groove can be cammed against the portion of the pawl to rotatably drive the pawl toward a latched position.

Some embodiments of the present invention provide a latch and method of latching a latch in which a striker moveable along a trajectory is releasably engaged with a catch that is rotatable about a first axis between a latched state and an unlatched state, and in which a pawl rotatable about a second axis is positioned for engagement with the catch, wherein the catch can be rotatably driven from an unlatched state to a latched state by movement of the striker or by rotation of the pawl, and wherein the pawl is rotatable to a position in which the pawl blocks rotation of the catch from the latched state to the unlatched state.

In some embodiments, a latch releasably engagable with a striker is provided, and includes a catch pivotable about a first axis between a latched position in which the catch retains the striker, and an unlatched position, and a pawl pivotable about a second axis, wherein the catch is responsive to force from the striker and the pawl to pivot from an unlatched position to a latched position of the catch, and is responsive to movement of the pawl (and in some cases force exerted by the pawl) to pivot from the latched position to the unlatched position of the catch.

Some embodiments of the present invention provide a latch and latching method in which a catch is rotated about a first axis from an unlatched state in which the catch can receive a striker, to a latched state in which the catch releasably retains the striker against removal from the latch, and a pawl rotated about a second axis and in camming contact across with a surface of the catch from the unlatched state of the catch to the latched state of the catch to drive the catch from the unlatched state to the latched state.

In some embodiments, a latch releasably engagable with a striker is provided, and includes a catch pivotable about a first axis between a latched position in which the catch retains the striker, and an unlatched position, and a pawl pivotable about a second axis, wherein the pawl is rotatable in a first direction to generate rotation of the catch from the latched position to the unlatched position, and is rotatable in a second direction opposite the first direction to generate rotation of the catch from the unlatched position to the latched position.

Other aspects of the invention will become apparent by consideration of the detailed description and accompanying drawings.

DETAILED DESCRIPTION

Before any embodiments of the present invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
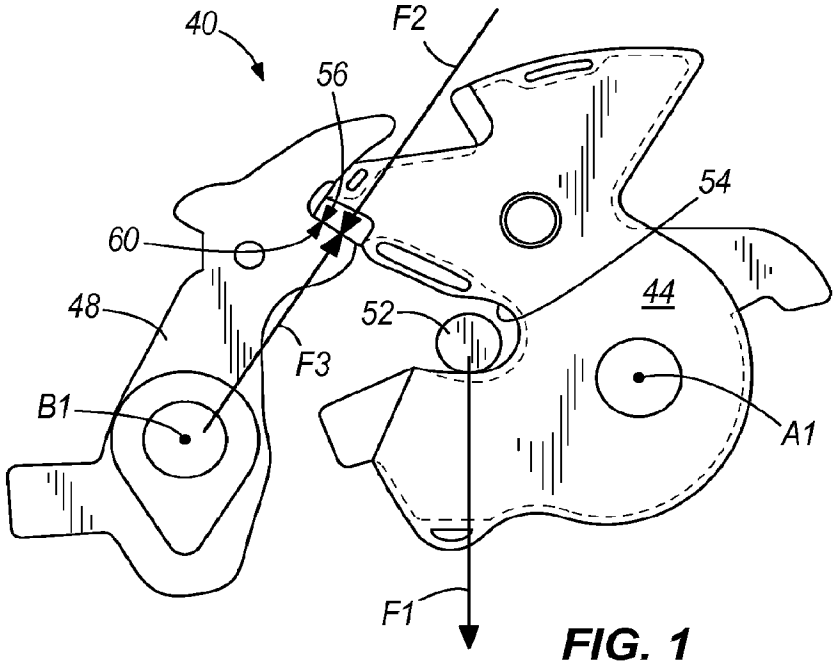
FIG. 1 PRIOR ART
FIG. 1 illustrates a prior art latch in a latched state with basic force vectors applied.

FIG. 1 illustrates a conventional latch 40 which may be used to selectively hold shut an item such as a door (e.g., a vehicle door, hatch, decklid or trunk, and the like). The latch 40 includes a catch 44 and a pawl 48. As is common in conventional latches, the catch 44 is rotatable about a first axis A1 to selectively engage and trap a striker 52 within a groove 54 formed in the catch 44, whereas the pawl 48 is positioned adjacent the catch 44 and is pivotable about a second axis B1 parallel with the first axis A1 of the catch 44. The pawl 48 has a flat engagement surface 56 configured to engage a corresponding flat engagement surface 60 of the catch 44 to retain the catch 44 in the latched position of FIG. 1, keeping the striker 52 retained within the groove 54. In the case of automotive doors and the like, the striker 52 may be fixed to a door frame and the latch 40 may be mounted at the edge of a door that is swingable relative to the door frame, although these positions of the striker 52 and latch 40 can be reversed in other embodiments. The door is opened by releasing the pawl 48 from the engaged position of FIG. 1 so that the catch 44 can rotate about the first axis A1 to free the striker 52. When the door is swung closed, the striker 52 is forced into the groove 54, thereby rotating the catch 44 toward the latched position of FIG. 1. The pawl 48 is typically spring-biased toward the latched position of FIG. 1 so that it automatically locks the catch 44 in the latched position.

In a tight-fitting door, such as a vehicle door with a compressible weather strip between the door frame and the door, the striker 52 exhibits a force on the catch 44 as shown by arrow F1 in FIG. 1. Similar forces can be present under certain extreme conditions of the latch 40, such as under impact, under inertial loading resulting from a vehicle rollover or other accident, and the like. The force F1 from the striker 52 is offset from the first axis A1, and urges the catch 44 in a counterclockwise direction to exhibit a force (arrow F2 in FIG. 1) on the pawl 48. The pawl 48 exhibits a reaction force (arrow F3 of FIG. 1) that keeps the catch 44 from rotating out of the latched position of FIG. 1. Although surface contact exists between the engagement surfaces 56, 60, the pressure between the surfaces can be resolved to theoretical point loads for analysis as shown in FIG. 1. The line of the forces F2 and F3 is generally aligned with the pawl's axis B1 or is spaced from the axis B1 in a direction toward the catch 44 to make the pawl 48 stable against accidental release as the striker 52 bears against the catch 44.

Figure 2:
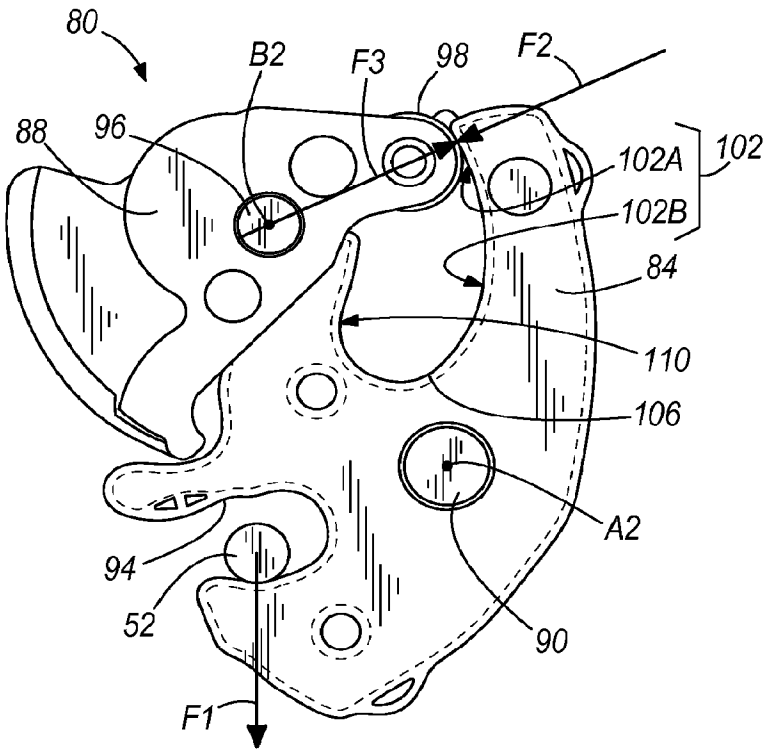
FIG. 2 illustrates a latch according to an embodiment of the present invention, the latch being shown in a latched state with basic force vectors applied.

FIG. 2 illustrates a latch 80 according to an embodiment of the present invention. The illustrated latch 80 includes a catch 84 and a pawl 88. The catch 84 is rotatable about a first axis A2 (defined by a first axle, pivot, or pin—hereinafter referred to simply as "pin" 90 for ease of description) to selectively engage and trap a striker 52 within a groove 94 defined in a body of the catch 84. The pawl 88 is positioned adjacent the catch 84 and is pivotable about a second axis B2 (defined by a second axle, pivot, or pin—hereinafter referred to simply as "pin" 96 for ease of description) that can be parallel with the first axis A2 of the catch 84. The striker 52 may exhibit a force on the catch 84 as shown by arrow F1 in FIG. 2 when latched, such as by a compressed door seal or from any other source as described above. The force F1 from the illustrated striker 52 is offset from the first axis A2 and urges the catch 84 in a counterclockwise direction to exhibit a force (arrow F2 in FIG. 2) on the pawl 88. The pawl 88 exhibits a reaction force (arrow F3 of FIG. 2) that keeps the catch 84 from rotating out of the latched position of FIG. 2. The line of the forces F2 and F3 in the illustrated embodiment is substantially aligned with the pawl's axis B2 so that the pawl 88 is stable against movement from the latched position of FIG. 2 as the striker 52 bears against the catch 84. Regardless of the magnitude of the forces F2 and F3, no rotational load is applied to the pawl 88 when the forces F2 and F3 are aligned with the pawl's axis B2. It will also be appreciated that negligible or very little rotational load is applied to the pawl 88 when the forces F2 and F3 are generally aligned with the pawl's axis B2.

Rather than flat engagement surfaces between the catch 84 and the pawl 88, the pawl 88 of the embodiment in FIG. 2 is provided with a roller 98 (e.g., a roller bearing), and the catch 84 is provided with a contoured cam surface 102. In the illustrated construction, the cam surface 102 forms part of a groove 106 in the catch 84 in which a portion of the pawl 88 is received. In some embodiments, the portion of the pawl 88 can be an appendage or other protrusion of the pawl 88. As described in further detail below, the engagement between the roller 98 and the cam surface 102 offers operational features and benefits unattainable with the traditional latch 80. Unlike the conventional latch 40 of FIG. 1, a low friction engagement is established between the catch 84 and the pawl 88 due to the roller 98. Among other things, the low friction engagement allows easier movement of the pawl 88 away from the latched position. Also, a stable latched state of the pawl 88 and catch 84 is provided by the contoured cam surface 102.

The cam surface 102 of the catch 84 in FIG. 2 has a first portion 102A with a curvature that is concentric or generally concentric with the axis B2 of the pawl 88 when the catch 84 is in the latched position. This relationship is what allows the forces F2, F3 between the catch 84 and the pawl 88 to be aligned with the axis B2 of the pawl 88 in the latched state. A second portion 102B of the cam surface 102 is non-concentric with the axis B2 of the pawl 88 in the latched state. In the illustrated embodiment of FIG. 2, the second portion 102B makes up a majority portion of the cam surface 102 along which the pawl 88 moves and contacts in at least one operation of the latch 80. Although the cam surface 102 transitions smoothly between the first portion 102A and the second portion 102B, the second portion 102B acts as a camming portion by which motion of at least one of the catch 84 and the pawl 88 is operable to drive the motion of the other. This results in a fundamentally different type of movement compared with the conventional latch 40 of FIG. 1.

The catch 84 and the pawl 88 of the latch 80 are co-drivable (i.e., movement of either one can drive movement of the other). For example, the catch 84 and the pawl 88 of FIG. 2 can move together, or "synchronously" substantially throughout the movement of the latch 80 from the latched position to the unlatched position and vice versa, whereas the pawl 48 of the conventional latch is simply removed from the catch 44 for unlatching, and has no corresponding motion during movement of the catch 44 between its latched and unlatched positions. As used herein, the term "synchronously" means that, in a range of motion of one element, the other element has a corresponding range of motion, and in which each position of each element at least partially defines a corresponding position of the other element. In some embodiments of the present invention, this synchronous motion between the catch 84 and pawl 88 exists throughout the range of movement of the pawl 88 or catch 84 (and in some embodiments, throughout the range of movement of both the pawl 88 and catch 84) between the latched and unlatched states of the latch 80. In other embodiments, this synchronous motion between the catch 84 and pawl 88 exists throughout at least a majority of the range of movement of the pawl 88 or catch 84 (and in some embodiments, throughout at least a majority of the range of movement of both the pawl 88 and catch 84) between the latched and unlatched states of the latch 80.

The synchronous movement of the catch 84 and the pawl 88 of the illustrated latch 80 from the latched position of the latch 80 (FIG. 3A) to the unlatched position of the latch 80 (FIG. 3D) is illustrated in FIGS. 3A to 3D, and operation of the latch 80 is described below with reference to these figures, it being understood that in the illustrated embodiment and in other embodiments, similar synchronous movement of the catch 84 and the pawl 88 of the latch 80 from the unlatched position of the latch 80 to the latched position of the latch 80 is possible.

Figure 3D:
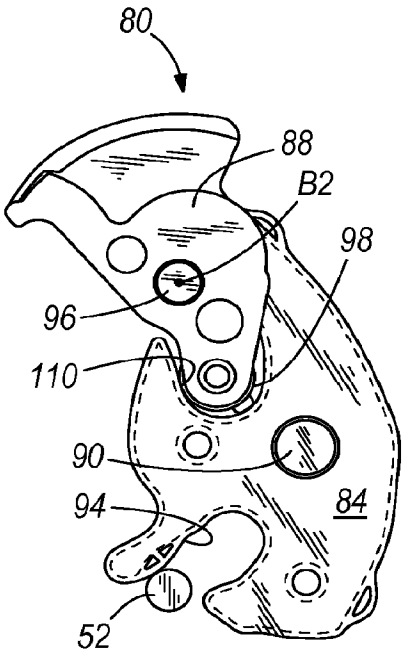
FIGS. 3A-3D illustrate a sequence of the latch of FIG. 2 transitioning from the latched state to an unlatched state.
Figure 3C:
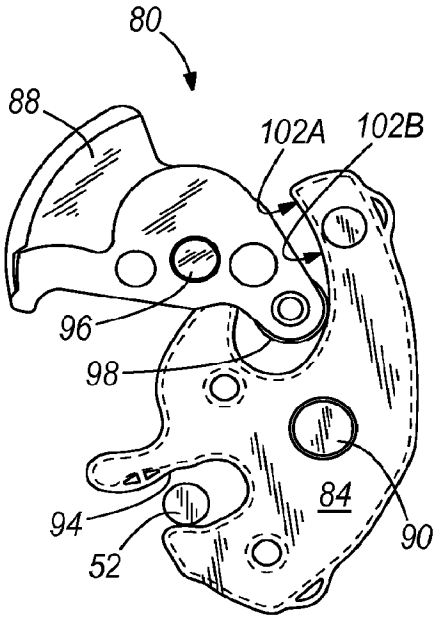
Figure 3B:
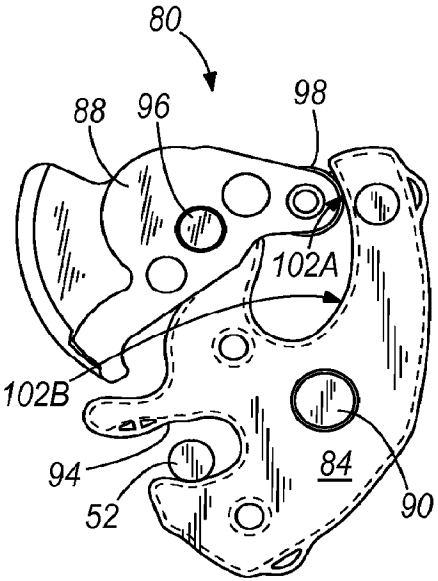
Figure 3A:
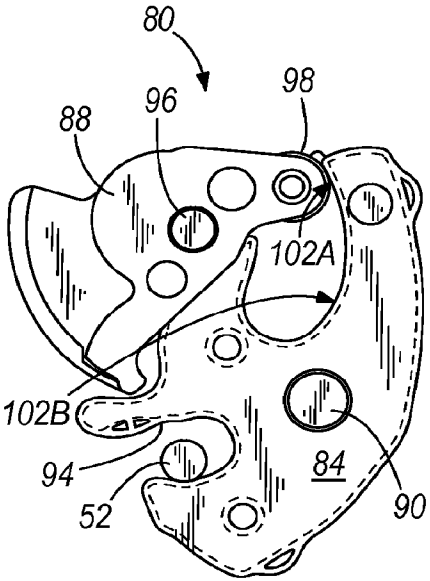

As shown in FIG. 3A, the striker 52 of the illustrated embodiment is retained within the groove 94 of the catch 84, and the roller 98 of the pawl 88 is in contact with the first portion 102A of the cam surface 102. In this position, downward force from the striker 52 does not cause counterclockwise rotation of the catch 84 to the unlatched position, since the pawl 88 provides the requisite reaction force to prevent movement of the catch 84 from the latched position of 3A. When it is desired to release the latch 80, the pawl 88 is rotated clockwise so that the roller 98 is moved from the first portion 102A to the second portion 102B of the cam surface 102. Movement of the roller 98 along the second portion 102B of the cam surface 102 causes corresponding synchronous movement of the catch 84. Unlike the conventional latch 40, the catch 84 and the pawl 88 of the latch 80 rotate in opposite directions as the latch 80 is released. After traversing the second portion 102B of the cam surface 102 in the unlatching direction, the roller 98 may leave the cam surface 102 and contact an adjacent surface 110 of the groove 106 in the fully unlatched position (FIG. 3D). In this position, the striker 52 is free to be removed from the catch 84.

In some embodiments, the catch 84 is spring-biased to an unlatched position in at least a portion of the range of rotational movement of the catch 84, such as by a spring (not shown) coupled to the catch 84. Therefore, as the pawl 88 in the illustrated embodiment of FIGS. 3A-3D is rotated toward an unlatched position, the catch 84 is likewise biased toward and moves toward its unlatched position. In other embodiments, however, the catch 84 is not biased toward its unlatched position. In these and other embodiments, the pawl 88 (e.g., the roller 98 of the pawl 88) can rotate to move into contact with a surface 110 of the catch 84 in order to cam against and rotate the catch 84 toward its unlatched position. In such cases, the surface 110 of the catch 84 against which the pawl 88 cams in this manner can at least partially define a groove 106 of the catch 84 as described above, and in some embodiments can at least partially define a side of a groove 106 opposite the cam surface 102.

To return to the latched position of the latch 80 illustrated in FIGS. 3A-3D, the above-described process is reversed, beginning with the striker 52 contacting the catch 84 and initiating rotation of the catch 84 about its axis A2 in the clockwise direction. This demonstrates how the catch 84 and the pawl 88 not only have synchronous movement, but can furthermore have bi-directional synchronous movement by which either of the catch 84 and the pawl 88 is operable to rotate the other. Rotation of the illustrated catch 84 toward the latched position can bring the surface 110 of the catch 84 into engagement with the roller 98 of the pawl 88 (if this engagement has not already been established), after which time further rotation of the catch 84 drives rotation of the pawl 88 in the counterclockwise direction about its axis B2 toward the latched position. In this case, the pawl 88 (e.g., roller 98) can contact and cam along the cam surface 102 of the catch 84, and in some embodiments can return to a position engaged with the first portion 102A of the cam surface 102. The catch 84 and the pawl 88 may be returned to their latched positions solely by the manual action of the striker 52, or in combination with one or more active or passive assist devices, such as a motor or other powered actuator, or a spring (e.g., an over-center spring).

Figure 4:
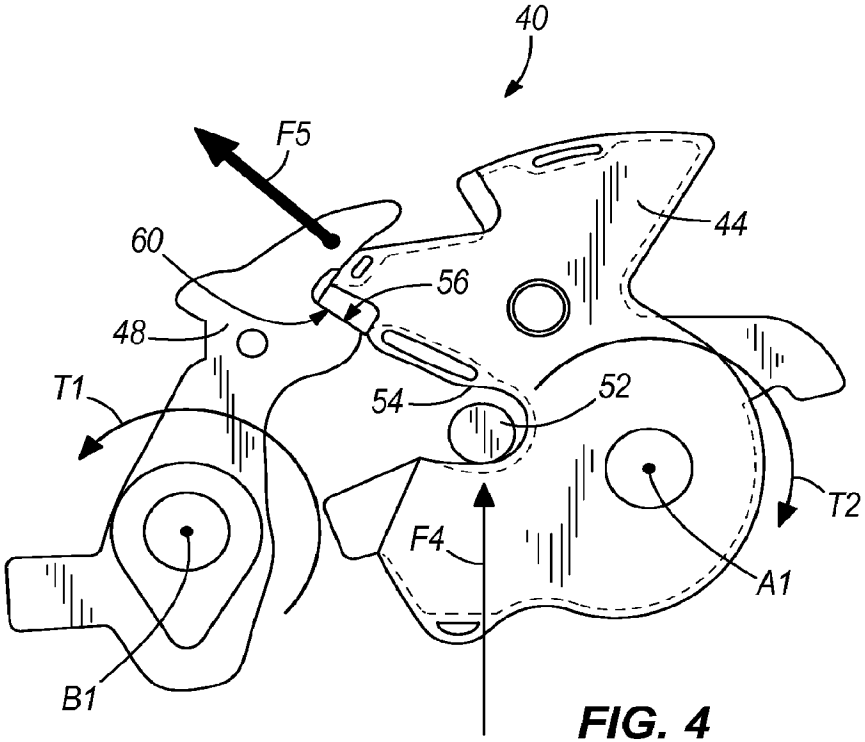
FIG. 4 PRIOR ART
FIG. 4 illustrates the prior art latch of FIG. 1, shown with vectors illustrating various motive forces for moving the latch components.

As illustrated in FIG. 4, various forces may be applied to the catch 44 and the pawl 48 of the conventional latch 40. In the most basic manual operation, a manual closing force F4 is applied to the catch 44 via the striker 52 to drive the catch 44 from the unlatched position (not shown) to the latched position. Likewise, a manual opening force F5 may be applied to the pawl 48 to pull the pawl 48 out of engagement with the catch 44. It should be noted that even when the manual opening force F5 is sufficient to retract the pawl 48, another force must typically be applied to the catch 44 to effect movement of the catch 44 to the unlatched position, since the pawl 48 is not capable of driving the catch 44 to the unlatched position.

With continued reference to FIG. 4, the conventional latch 40 may also be used in a powered latch assembly. When the conventional latch 40 is used in a powered latch assembly, the pawl 48 can be released or disengaged from the catch 44 by a first torque T1 applied to the pawl 48. Movement of the catch 44 to the unlatched position is then dependent upon a release force applied by the striker 52 itself or another force applied directly to the catch 44. If it is desired to allow powered cinching of the striker 52 with the catch 44, a second torque T2 must be applied directly to the catch 44 (i.e., not applied to the catch 44 via the pawl 48).

Figure 5:
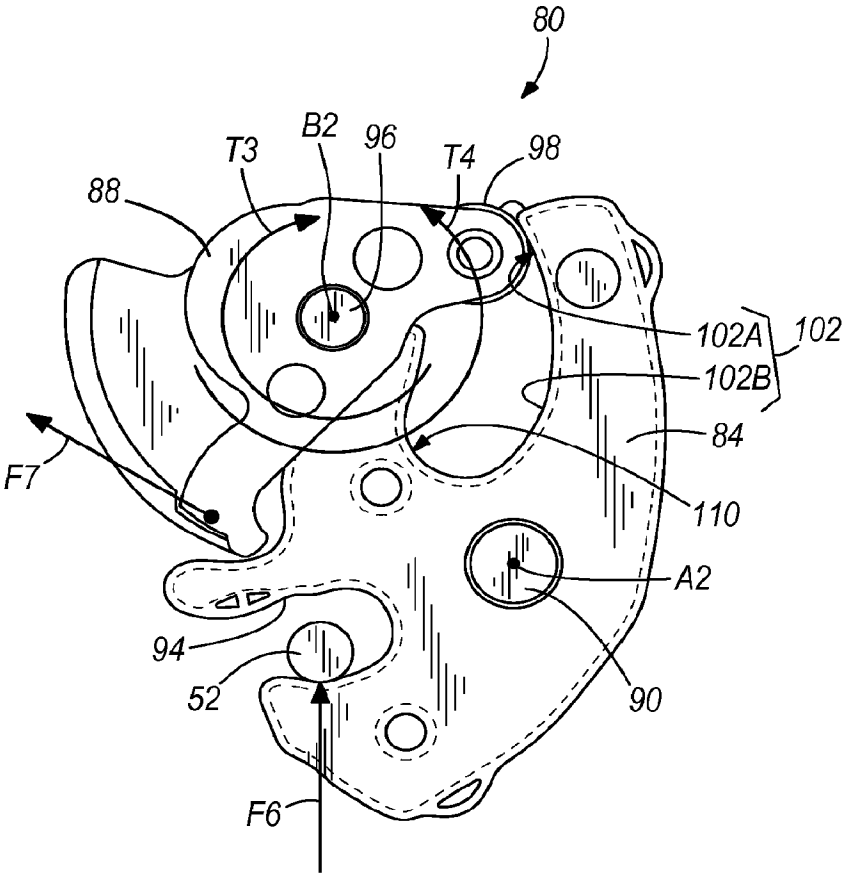
FIG. 5 illustrates the latch of FIG. 2, shown with vectors illustrating various motive forces for moving the latch components.

FIG. 5 illustrates at least one aspect of how the latch 80 of FIG. 2 differs from the conventional latch 40 of FIGS. 1 and 4. While a manual closing force F6 from the striker 52 can drive motion of the illustrated catch 84 toward the latched position, and a manual opening force F7 can be applied to the pawl 88 for releasing the catch 84, the manual opening force F7 can be significantly less than the manual opening force F5 required to release the pawl 48 of the conventional latch 40. Because the illustrated catch 84 and pawl 88 have a cam and cam-follower engagement, rather than flat engagement surfaces that contact when latched, the friction that must be overcome to move the pawl 88 from its latched position can be significantly lower than that of the conventional latch 40. Furthermore, the illustrated pawl 88 is provided with the roller 98 for rolling across the cam surface 102, thereby significantly reducing friction by substantially eliminating sliding or dragging action between the catch 84 and the pawl 88.

In the illustrated embodiments of FIGS. 2, 3, and 5, the cam surface 102 of the catch 84 has a generally concave shape facing the pawl 88. This concave shape of the first portion 102*a* of the cam surface 102 can enable an enhanced degree of stability between the catch 84 and the pawl 88 when the catch 84 and pawl 88 are in a latched state by reducing or eliminating forces that would otherwise urge these elements to move toward their unlatched positions. This stability can be enhanced when used in conjunction with the concentricity of the cam surface 102 about the axis of rotation B2 of the pawl 88 as described above—another feature that reduces or eliminates forces urging the catch 84 and pawl 88 from their latched positions.

The generally concave shape of the second portion 102*b* can provide significant mechanical advantage when the pawl 88 is used to drive the catch 84 to a latched state, as will be described in greater detail below. Although the shapes of the cam surfaces 102*a*, 102*b*, 110 described and illustrated herein can provide significant benefits in various latch embodiments according to the present invention, in other embodiments, any or all of the cam surfaces 102*a*, 102*b*, 110 can instead be flat, convex, or can have any other shape desired that is capable of transferring mechanical force between the catch 84 and the pawl 88 as described herein.

With further reference to FIG. 5, a first torque T3 may be applied to the pawl 88 by a powered actuator to move the pawl 88 from its latched position to its unlatched position when the latch 80 is used in a powered latch assembly. Movement of the catch 84 toward the unlatched position can then be automatically effected since the catch 84 and the pawl 88 exhibit synchronous motion as discussed above. Aside from the camming force from the pawl 88 and/or a spring force or other biasing force upon the catch 84 toward an unlatched position (and also the force which may inherently exist from the striker 52 bearing on the groove 94 of the catch 84 in a tight-fitting door, or the like), no additional force needs to be applied to the catch 84 by any other means for unlatching and releasing the striker 52. If it is desired to also enable powered cinching of the striker 52 with the catch 84, a second torque T4 may be applied to the pawl 88 and transferred to the catch 84. This negates the need for separate actuators or the complicated transmission mechanism that can be necessary to separately power both the pawl and the catch with a single actuator. Thus, the size of a powered latch assembly using the latch 80 is reduced and the number of parts and the degree of complexity can be reduced. Also, the number of inputs to the latch 80 (i.e., sources of force for actuating elements of the latch 80) can be reduced by virtue of the fact that the pawl 88 can be moved in opposite directions to perform different functions (e.g., a powered cinching input to the pawl 88, as described in more detail below, and a catch release input to the pawl 88, as described above). The second portion 102B of the cam surface 102 can also provide a significant mechanical advantage (e.g. 10:1) for amplifying the cinching torque present on the catch 84 for a given torque T4 available at the pawl 88.

Figure 6:
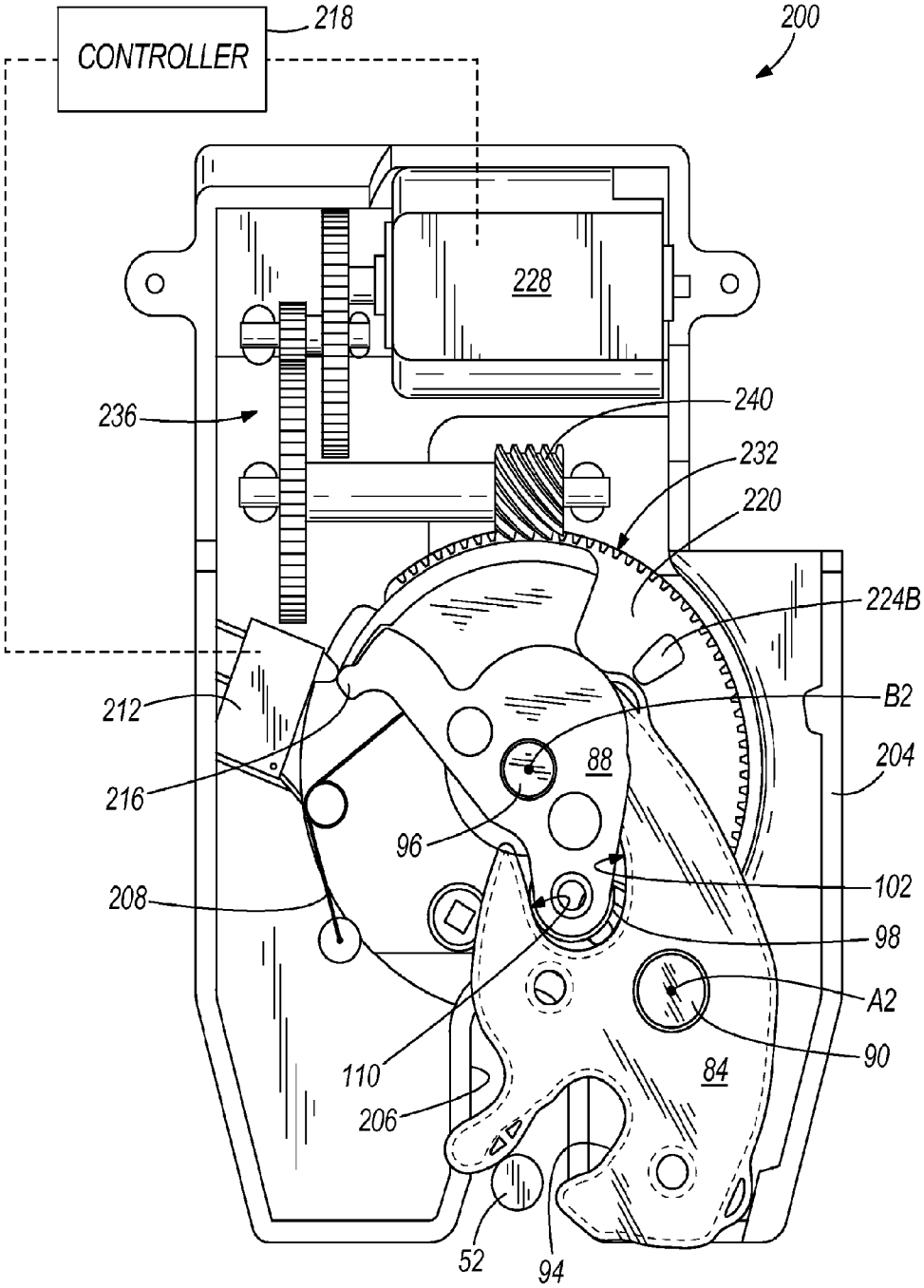
FIG. 6 is a front view of a power latch assembly utilizing the latch of FIG. 2, the power latch assembly being shown in an unlatched state.
Figure 7:
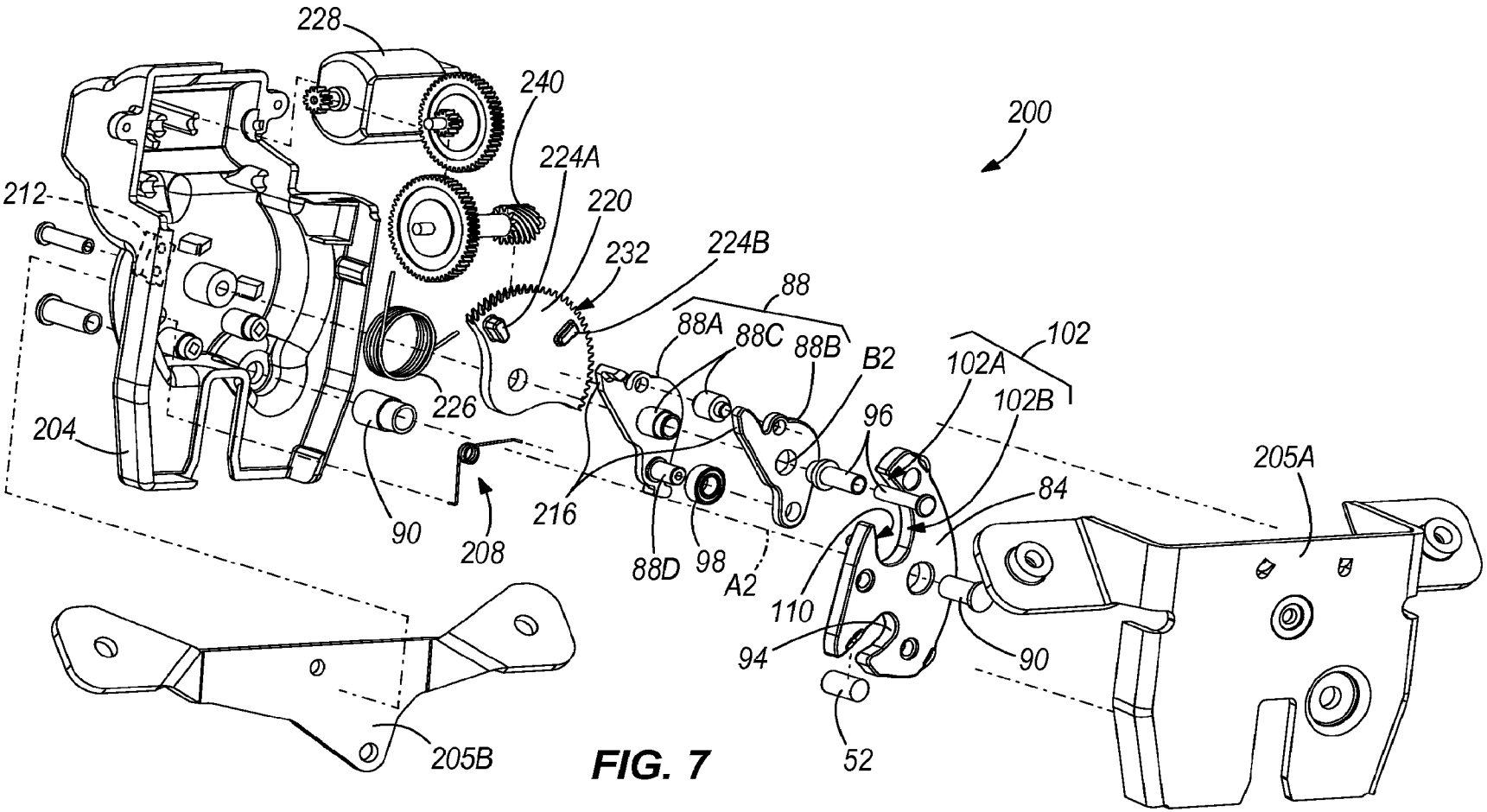
FIG. 7 is an exploded assembly view of the power latch assembly of FIG. 6.

FIGS. 6-11B illustrate a powered latch assembly 200 including the latch 80 of FIG. 2. In this embodiment, the catch 84 and the pawl 88 are rotatably mounted at least partially within a housing 204. As shown in FIG. 7, the housing 204 is sandwiched between a frame plate 205A and a support plate 205B, both of which are riveted to the housing 204 in the illustrated construction. The housing 204 includes an opening 206 allowing entry of the striker 52 into the groove 94 of the catch 84 for latching. Both the catch 84 and the pawl 88 are rotatable relative to the housing 204 about their respective axes A2, B2 as described above. In this embodiment, an over-center spring 208 is coupled between the pawl 88 and the housing 204, and urges the pawl 88 to the latched position or the unlatched position depending upon the particular orientation of the pawl 88 in relation to the over-center spring 208. With further reference to the illustrated embodiment of FIGS. 6-11B, a sensor 212 is provided in the housing 204 to sense the position of the pawl 88. The illustrated pawl 88 includes a portion 216 that contacts the sensor 212 (e.g., a push-type contact switch or other suitable switch) when the pawl 88 is in the unlatched position (FIG. 6) so that the sensor 212 is operable to generate a signal indicative of whether the pawl 88 is in the unlatched position. The signal may be transmitted to a controller 218. It should be noted that other types of sensors, including non-contact type sensors, may be used to determine whether the pawl 88 is in the unlatched position. In some embodiments, the sensor 212 or any number of other sensors can be positioned and adapted to sense (and generate corresponding signals) more specific information regarding the position of the pawl 88 or other elements of the latch 80. For example, a sensor may positively sense the achievement of both the latched and unlatched positions of the pawl 88 and generate corresponding signals.

With reference now to FIG. 7, the illustrated power latch assembly 200 is shown in greater detail. In the illustrated embodiment, the pawl 88 is constructed of multiple individual pieces. As shown in FIG. 7, the pawl 88 can be constructed of two plate-like members 88A, 88B separated by at least one spacer 88C integral with and/or separate from the plate-like members 88A, 88B. The roller 98 is positioned on a post 88D that is integral with a first of the plate-like members 88A. In other embodiments, the pawl 88 is constructed of fewer elements, such as a single integral element comprising the plate-like members 88A, 88B and spacers 88C shown in FIG. 7 and carrying a roller 98 as described above. Alternatively, the pawl 88 can be constructed of a single plate-like member of any suitable thickness shaped to carry the roller 98 and defining the portion 216 positioned to trigger the sensor 212 as described above, or a body otherwise adapted to perform these functions. In still other embodiments, one or more portions of a pawl body can define the camming element or surface used to cam with the catch 84. Still other pawl arrangements and constructions are possible, and fall within the spirit and scope of the present invention.

In some embodiments of the present invention, it is desirable to provide a lost motion connection between the pawl 88 and a primary mover of the pawl 88 (e.g., a motor 228 in the illustrated embodiment as described below, a solenoid, or other actuator positioned to drive and rotate the pawl 88). This lost motion can enable movement of the pawl 88 independent of movement of the primary mover—a feature that can be useful in embodiments in which the pawl 88 can be moved by the catch 84 (for example). The lost motion connection between the primary mover and the pawl 88 can take various forms depending at least in part upon the type of primary mover used and the position of the primary mover in the latch assembly 200.

By way of example only, the lost motion connection in the illustrated latch assembly 200 of FIGS. 6-11B is provided by a bi-directional driver 220 positioned and shaped to drive rotation of the pawl 88 in either a clockwise direction or a counterclockwise direction. In the illustrated embodiment, the driver 220 is rotatably mounted upon the same pin 96 as the pawl 88 (and therefore can rotate about the same axis B2 as the pawl 88), although in other embodiments this need not necessarily be the case. By virtue of the lost motion connection between the illustrated driver 220 and the pawl 88, the exact amount of rotation of the driver 220 may not be transferred to the pawl 88 in all circumstances. As shown in FIG.

7, the illustrated driver 220 includes first and second protrusions 224A, 224B that selectively engage the pawl 88 to drive rotation thereof. The first protrusion 224A of the illustrated driver 220 is configured to drive the pawl 88 counterclockwise (toward the latching position), and the second protrusion 224B is configured to drive the pawl 88 clockwise (toward the unlatching position). In the illustrated embodiment, the driver 220 is biased to a neutral position (FIG. 6) by a torsion spring 226 (FIG. 7), although any other suitable biasing elements or devices can be used for this purpose, such as magnets or electromagnets, extension springs, elastic bands, and the like.

The driver 220 in the embodiment of FIGS. 6-11B is moved by a powered actuator 228 to rotate and drive the pawl 88. In the illustrated embodiment, the actuator 228 is an electric motor that drives a toothed portion 232 of the driver 220 through a gear train 236. The illustrated gear train 236 includes a plurality of gears that reduce the speed of the actuator 228 and increase the torque. The gear train 236 can be configured to provide a large cinching torque to the driver 220 and the pawl 88, and ultimately to the catch 84 for cinching the striker 52, while using a relatively lightweight and low power actuator 228. In the illustrated embodiment, the final gear of the gear train 236 is a worm gear 240 that engages the toothed portion 232 of the driver 220, and enables the driver 220 to be rotated about an axis perpendicular to the worm gear 240. In other embodiments, any other number, orientation, and arrangement of gears in the gear train 236 can instead be used, as can other mechanical power transmission assemblies adapted to transfer mechanical power from the prime mover to the driver 220.

FIGS. 8A-8D illustrate the latching and power cinching sequence of the power latch assembly 200 of FIG. 6. Beginning at FIG. 8A, the catch 84 and the pawl 88 are in their respective unlatched positions. In this state, the designated portion 216 of the pawl 88 is in contact with the sensor 212, and the roller 98 of the pawl 88 is in contact with or in close proximity to the surface 110 adjacent the cam surface 102. The driver 220 is in a neutral or "home" position. The groove 94 in the catch 84 is in registry with the opening 206 in the housing 204 so that the striker 52 is able to enter the groove 94 through the opening 206. As indicated by the arrow in FIG. 8A, the striker 52 is received into the groove 94 of the catch 84. This may occur through movement of the striker 52, or through movement of the powered latch assembly 200 (e.g., with a swingable door, hatch, decklid, etc.) toward the striker 52.

Figure 8A:
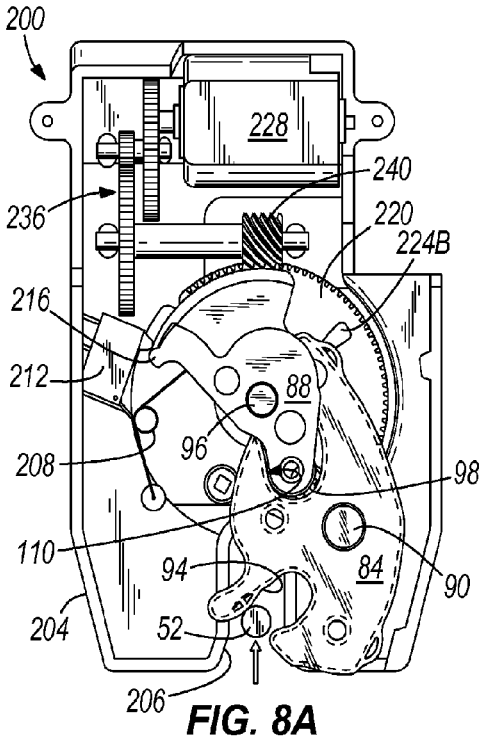
FIGS. 8A-8D illustrate a cinching action carried out by the power latch assembly of FIG. 6.
Figure 8B:
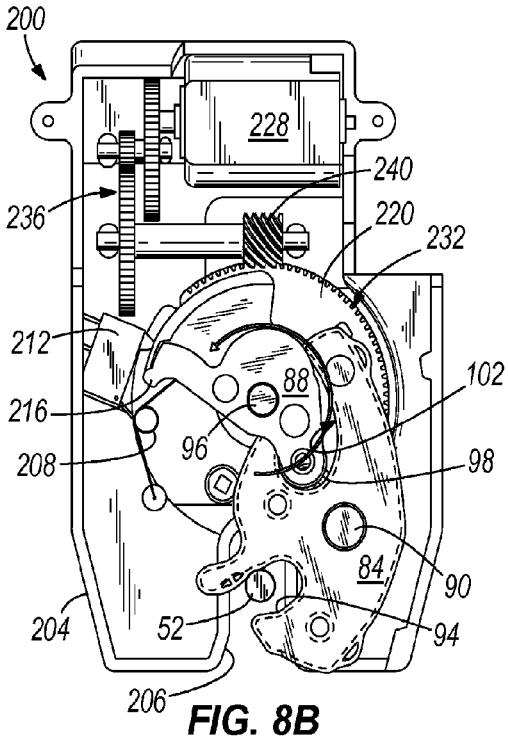

As shown in FIG. 8B, the striker 52 has further entered the opening 206 and the groove 94 of the catch 84 relative to its position in FIG. 8A. This movement of the striker 52 drives rotation of the catch 84 in the clockwise direction. Rotation of the catch 84 in the clockwise direction drives counterclockwise rotation of the pawl 88 as the surface 110 contacts the roller 98. This movement of the pawl 88 moves the portion 216 of the pawl 88 off of the sensor 212, which in turn transmits a signal to the controller 218 (see FIG. 6) that the striker 52 is now present in the groove 94 of the catch 84. Upon receipt of this signal from the sensor 212, the controller 218 sends a command signal to the actuator 228 to begin actuation. It should be noted that the over-center spring 208 may be overcome either before or after actuation by the actuator 228 begins. When the bias of the over-center spring 208 is overcome (i.e., the bias urging the pawl toward the unlatched position), the pawl 88 is biased by the over-center spring 208 toward the latched position.

Figure 8C:
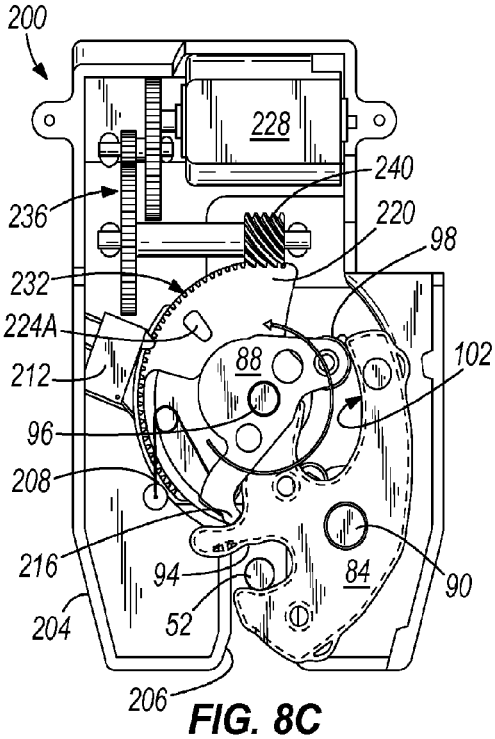

Between the state illustrated in FIG. 8B and that illustrated in FIG. 8C, the bias of the over-center spring 208 urging the pawl 88 toward the unlatched position is overcome, and the spring 208, along with the driver 220, drive rotation of the pawl 88 (and the catch 84) toward the latched positions of the pawl 88 and catch 84. During powered actuation by the actuator 228 in the illustrated embodiment, the worm gear 240 drives counterclockwise rotation of the driver 220 by engaging the toothed portion 232 of the driver 220. The driver 220 in turn drives the pawl 88 via the first protrusion 224A. As the actuator 228 moves the driver 220 to rotate the pawl 88, the roller 98 of the pawl 88 contacts the second portion 102B (see FIG. 7) of the cam surface 102 to drive the catch 84 toward the latched position. The shape of the second portion 102B of the cam surface 102 and its orientation relative to the pin 90 provides a mechanical advantage (e.g., about a 10:1 mechanical advantage in the illustrated embodiment, with other levels of mechanical advantage possible) that makes it easier for the actuator 228 to overcome the resistance of striker 52 to cinch the striker 52 tightly within the groove 94 of the catch 84.

Figure 8D:
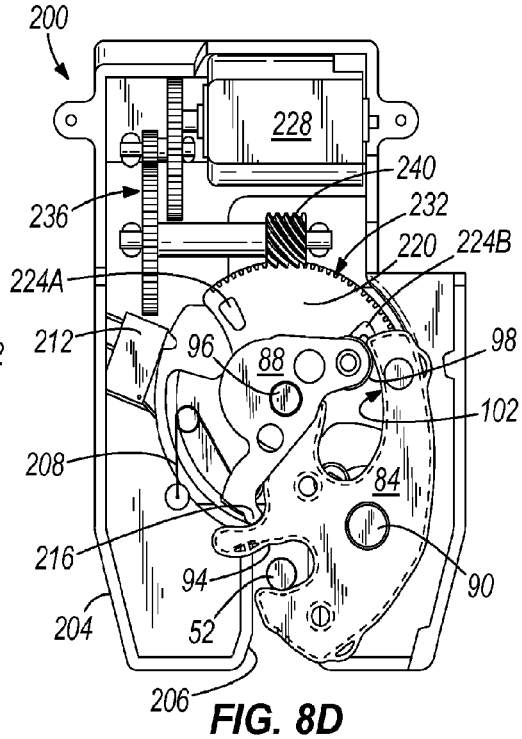

The controller 218 can be configured to direct the actuator 228 to operate to complete a predetermined number or rotations known to cause the driver 220 to drive the pawl 88 to the latched position before the controller 218 deactivates the actuator 228. In other embodiments, a load sensor (e.g., electrical load sensor on the actuator 228, strain gauge on any of mechanical power transmission components between the actuator 228 and the pawl 88, an optical sensor, a switch sensor, and the like) can instead be coupled to the controller 218 to turn off the actuator 228 when the pawl 88 has reached the latched position. Once the striker 52 has been cinched and the catch 84 and the pawl 88 have reached their latched positions (FIG. 8C), the pawl 88 retains the catch 84 in the latched position, and the driver 220 can return to the neutral position (FIG. 8D). In the illustrated embodiment, the torsion spring 226 of FIG. 7 is strong enough to return the driver 220 to the neutral position while the driver 220 is drivingly coupled with the actuator 228, which requires back-driving the actuator 228. In other embodiments, the actuator 228 and the driver 220 may be de-coupled (e.g., by a clutch) before the driver 220 is returned to the neutral position.

FIGS. 9A-9D illustrate a power release sequence of the power latch assembly 200 of FIG. 6. Beginning at FIG. 9A, the catch 84 and the pawl 88 are in their respective latched positions such that the roller 98 is in contact with the first portion 102A of the cam surface 102, and the striker 52 is retained securely by the catch 84. In this state, the sensor-activating portion 216 of the pawl 88 is positioned remotely from the sensor 212, and the driver 220 is in the neutral or "home" position.

Figure 9A:
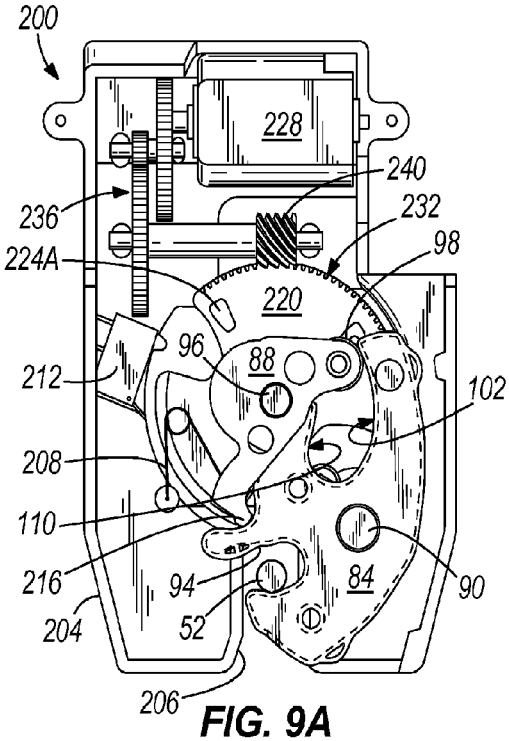
FIGS. 9A-9D illustrate a power release action carried out by the power latch assembly of FIG. 6.
Figure 9B:
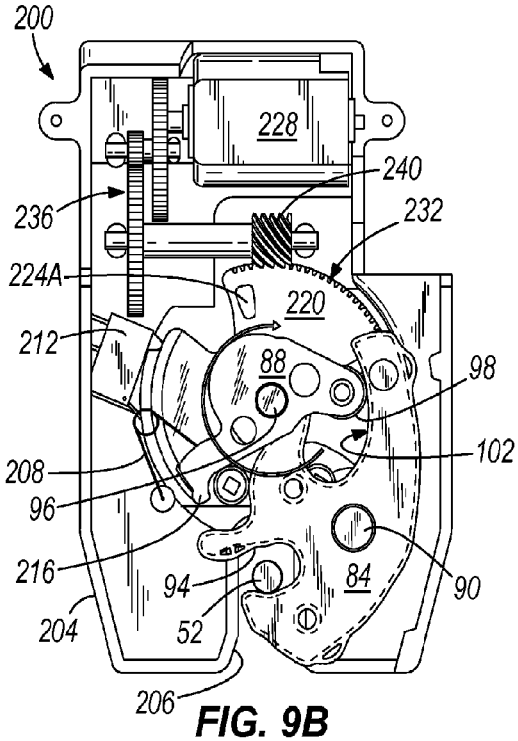
Figure 9C:
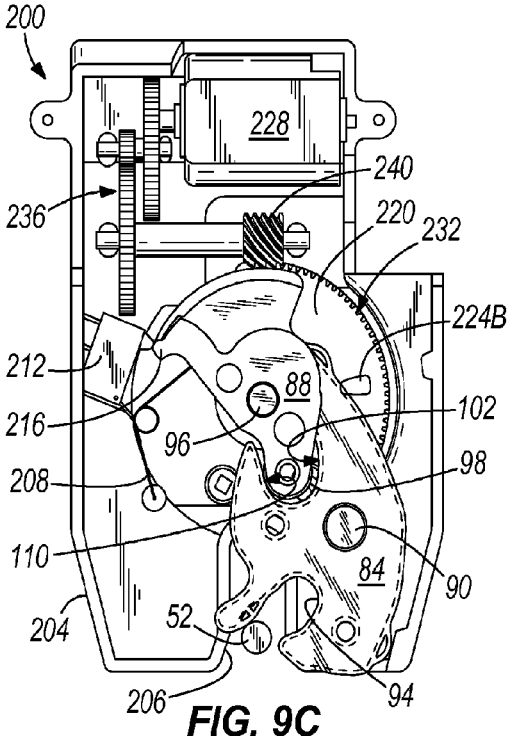
Figure 9D:
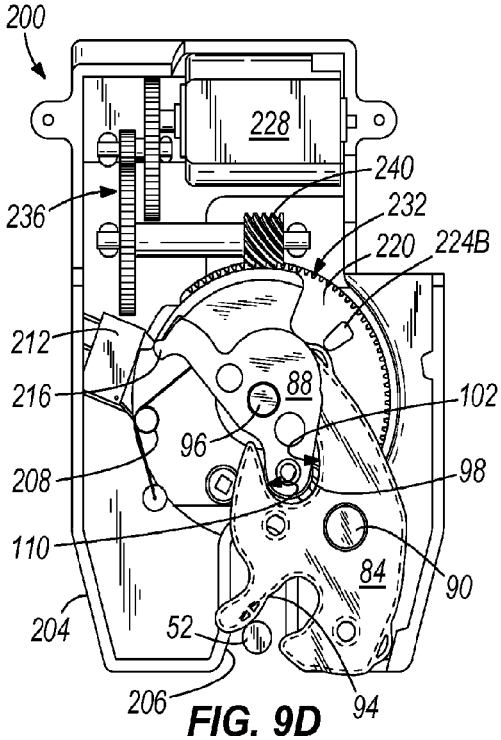

Upon receiving a signal to release the latch 80, the controller 218 (see FIG. 6) sends a command signal to the actuator 228 to begin actuation. The signal received by the controller 218 may come from a sensor coupled with a door handle and responsive to movement of the door handle, or may come from a wireless device, or any other known device. In the illustrated embodiment, and as described in greater detail above, the actuator 228 is an electric motor that drives rotation of the pawl 88 through the gear train 236 and the driver 220. As also discussed above, the illustrated gear train 236 includes the worm gear 240 that is engaged with the toothed portion 232 of the driver 220. In the unlatching process of the illustrated embodiment, the actuator 228 moves the driver 220 in a clockwise direction so that the second protrusion 224B of the driver 220 contacts and drives clockwise rotation of the pawl 88 to move the roller 98 from the first portion 102A to the second portion 102B of the cam surface 102. Also in the illustrated embodiment, the actuator 228 rotates the pawl 88 an amount sufficient to pass over the center of the over-center spring 208, at which time the spring 208 then biases the pawl 88 to the unlatched position of FIG. 9C. In some embodiments, the catch 84 is moved to its unlatched position as the roller 98 contacts the surface 110 adjacent the cam surface 102. When the pawl 88 of the illustrated embodiment reaches the unlatched position of FIG. 9C, the portion 216 of the pawl 88 actuates the sensor 212, which sends a signal to the controller 218 to indicate that unlatching is complete. The controller 218 can then stop the actuator 228, and the driver 220 can be returned by the torsion spring 226 (FIG. 7) to the neutral position as shown in FIG. 9D.

Low friction between the roller 98 of the pawl 88 and the cam surface 102 of the catch 84 allows the illustrated power latch assembly 200 to be unlatched with significantly less actuation force on the pawl 88 as compared to conventional latches. The gear train 236 between the actuator 228 and the pawl 88 allows an even further reduction in the operational requirements of the actuator 228, and allows the actuator 228 to be smaller, less expensive, and use less power to complete the unlatching operation. Because the operational forces on the pawl 88 can be so low, the pawl 88 need not be constructed of a particularly strong material, and can instead be made of an inexpensive and/or lightweight material such as plastic. It should also be noted that a single actuator (e.g., actuator 228 in the illustrated embodiment of FIGS. 6-11B) is operable for both power cinching operation and power release operations of the power latch assembly 200, eliminating the need for multiple actuators. As described above, the actuator 228 in the illustrated embodiment is operated to move the pawl 88 during power cinching and power releasing, and the catch 84 is moved to its corresponding positions in either case by movement of the pawl 88, since the catch 84 and the pawl 88 are configured for synchronous movement.

Figure 10B:
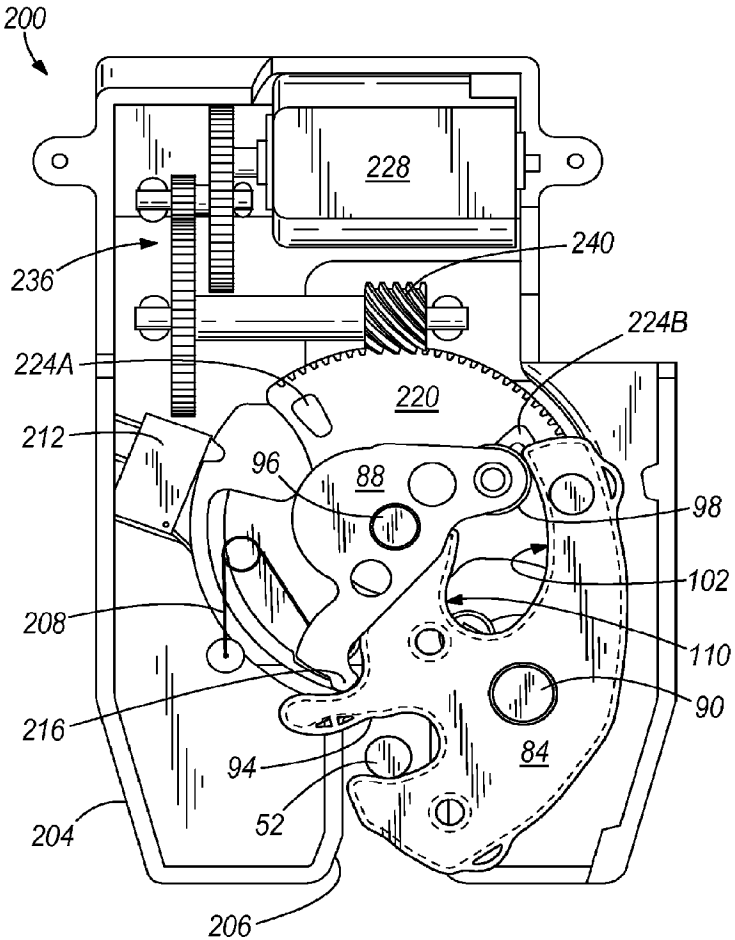
FIGS. 10A and 10B illustrate a manual latching action carried out by the power latch assembly of FIG. 6.
Figure 10A:
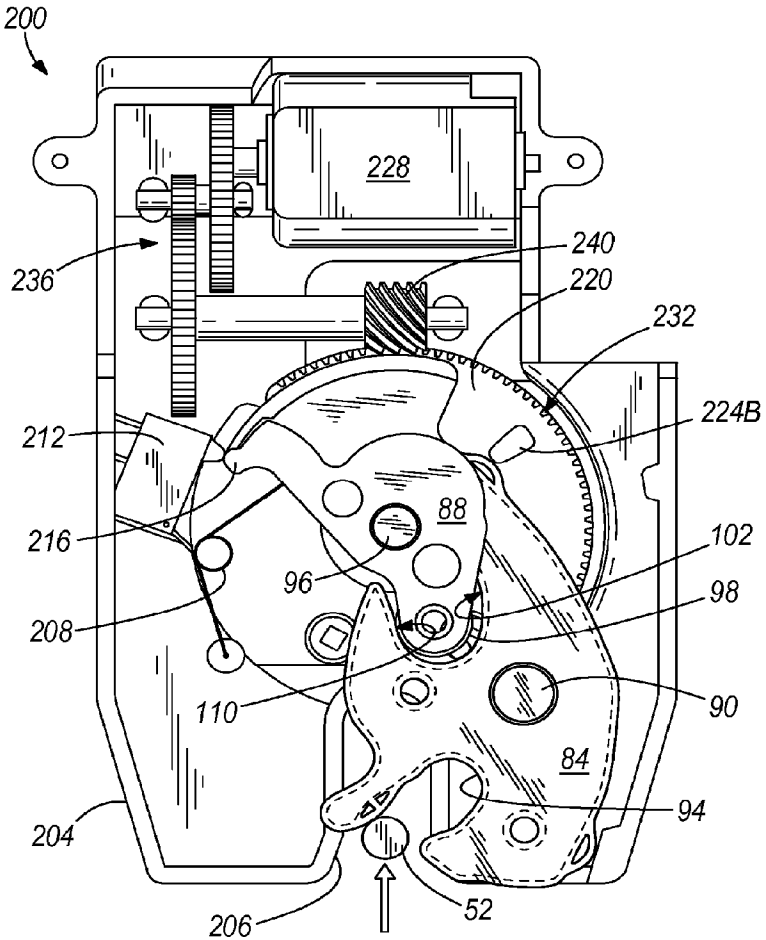

FIGS. 10A and 10B illustrate a manual latching sequence of the power latch assembly 200 of FIGS. 6-11B. This manual latching is carried out in the same manner as the above-described latching and power cinching sequence of FIGS. 8A-8D, except that the actuator 228 is not operated for cinching, and as a result need not necessarily be present (along with the gear train 236 and driver 220) in alternate embodiments. As shown in FIG. 10A, relative movement of the striker 52 against the catch 84 rotates the catch 84 clockwise. This rotation of the catch 84 causes corresponding rotation of the pawl 88 to an extent sufficient to cross over the center of the over-center spring 208 so that the spring 208 biases the pawl 88 to the latched position of FIG. 10B. Once the pawl 88 has reached the latched position, movement of the catch 84 out of its latched position is blocked by the pawl 88, whose roller 98 is in contact with the first portion 102A of the cam surface 102. In some embodiments, power cinching action of the power latch assembly 200 may be selectively controllable by the controller 218 so that the actuator 228 is only actuated for cinching under certain circumstances, or the power cinching feature can simply be deactivated for certain installations of the power latch assembly 200.

Figure 11B:
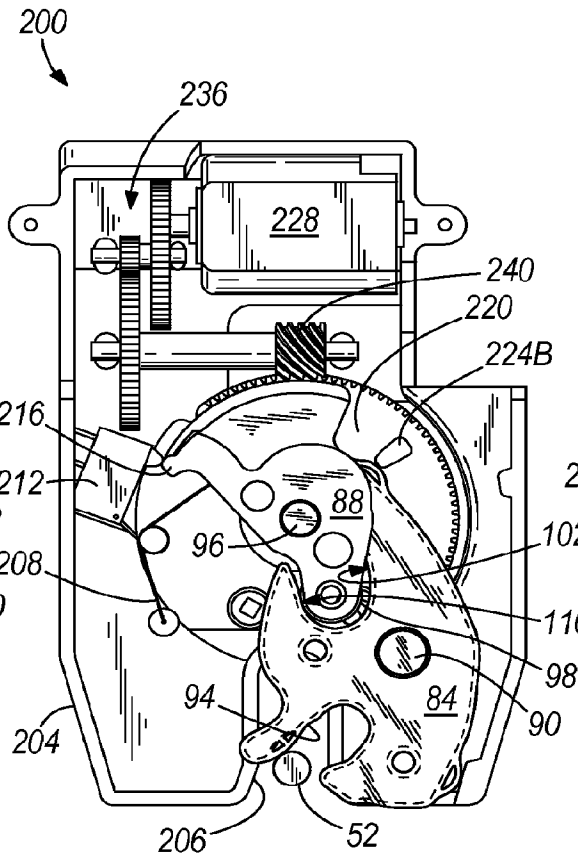
FIGS. 11A and 11B illustrate a manual release action carried out by the power latch assembly of FIG. 6.
Figure 11A:
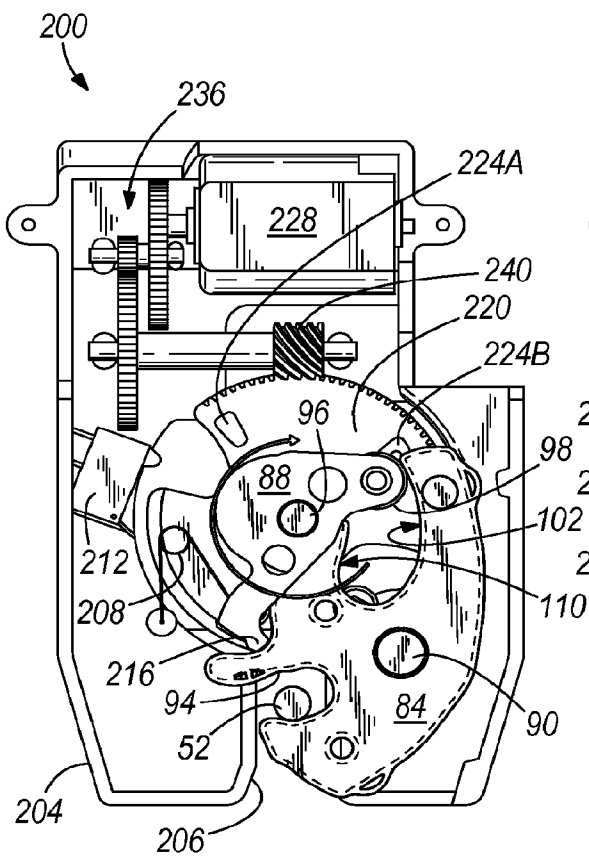

FIGS. 11A and 11B illustrate a manual release or unlatching sequence of the power latch assembly 200. Although the actuator 228 is present and operable to release the striker 52 from the catch 84, it may be desirable to provide an alternate element or device, or at least a back-up element or device, for effecting this release operation. Also, it should be noted that the actuator 228, gear train 236, and driver 220 need not necessarily be present to perform the manual release or unlatching sequence. Similar to the power release operation, a release force is applied directly to the pawl 88, and the catch 84 is moved to its unlatched position in response to actuation by the pawl 88. Although a particular manual actuator is not illustrated, any convenient element or device for inducing clockwise rotation of the pawl 88 can be provided. For example, a twistable knob can be directly or indirectly coupled to the pawl 88, or a cable can be attached to the pawl 88 (e.g., at a distance from the pin 96) and can be operable in response to actuation of a handle, lever, or other element to be pulled and to exhibit a torque on the pawl 88 for moving the roller 98 off of the first portion 102A of the cam surface 102. With continued reference to FIGS. 11*a* and 11*b*, the pawl 88 can be further manually movable past the crossover point of the over-center spring 208 so that the spring 208 biases the pawl 88 to the unlatched position of FIG. 11B. As described above, movement of the pawl 88 to the unlatched position causes corresponding movement of the catch 84 to its unlatched position so that the striker 52 is released from the groove 94.

Figure 12:
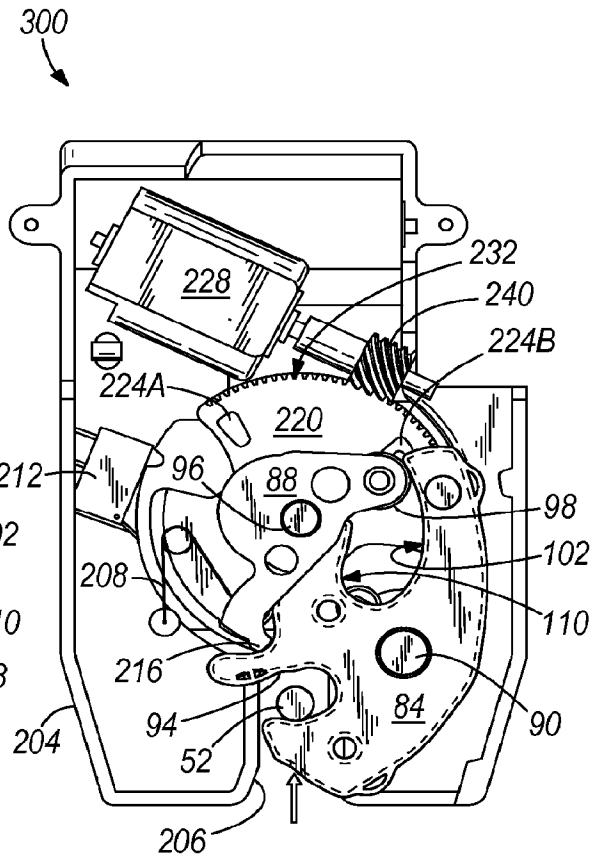
FIG. 12 is a front view of a power latch assembly similar to that of FIG. 6, the power latch assembly being shown in a latched state.

FIG. 12 illustrates another power latch assembly 300. Except as described herein, the power latch assembly 300 of FIG. 12 is structurally and functionally similar to the power latch assembly 200 of FIGS. 6-11B and thus, a duplicative description of the common features is not provided. Reference is hereby made to the description above in connection with FIGS. 6-11B for a more complete understanding of the features, elements, and operation (and possible alternatives to such features, elements, and operation) of the embodiment of FIG. 12. Common reference numbers are used where appropriate.

In the power latch assembly 300 of FIG. 12, the actuator 228 drives the worm gear 240 directly without other elements of the gear train 236 in the earlier-illustrated power latch assembly 200. Although the absence of the torque-increasing gear train 236 can limit the maximum torque that can be applied to the pawl 88 in power cinching or power release operations (assuming the actuators 228 in the two power latch assemblies 200, 300 are equivalent in output), the power latch assembly 300 can be configured in some embodiments to operate without power cinching capability (e.g., in installations where this feature is not necessary or desired). By eliminating the power cinching feature, the maximum demand for torque on the pawl 88 can be reduced to that which is necessary for a power release operation. Because a power release operation only requires that the pawl 88 be rotated to roll the roller 98 off the first portion 102A of the cam surface 102 and get over the crossover point of the over-center spring 208, the gear train 236 can be eliminated in some applications. Removal of the gear train 236 allows overall reduction in the size and/or weight of the power latch assembly 300, and although not shown, the housing 204 can be reduced in size to more closely follow the contour of the actuator 228, which in the illustrated embodiment is oriented at an angle compared with the orientation of the actuator 228 in the power latch assembly 200 of FIGS. 6-11B. Furthermore, where power cinching is not needed or desired, the driver 220 can be simplified by removing the first protrusion 224A, and can be made smaller as a whole if desired.

As an alternate to removing the gear train 236 in the power latch assembly 300, the gear train 236 from the power cinch-capable latch assembly 200 may be retained, in which case a smaller, lighter, and less powerful actuator may be used, and an overall reduction in size and weight may still be achieved.

Although the power latch assembly 300 of FIG. 12 is described as having only a power release function and not a power cinching function, both power functions can be provided in other embodiments. However, in such cases, and depending at least in part upon the necessary force to perform cinching operations, the actuator 228 in the power latch assembly 300 may need to be more powerful than that of the power latch assembly 200, and may not need to rely upon a torque increase from a gear train for power cinching.

Figure 13B:
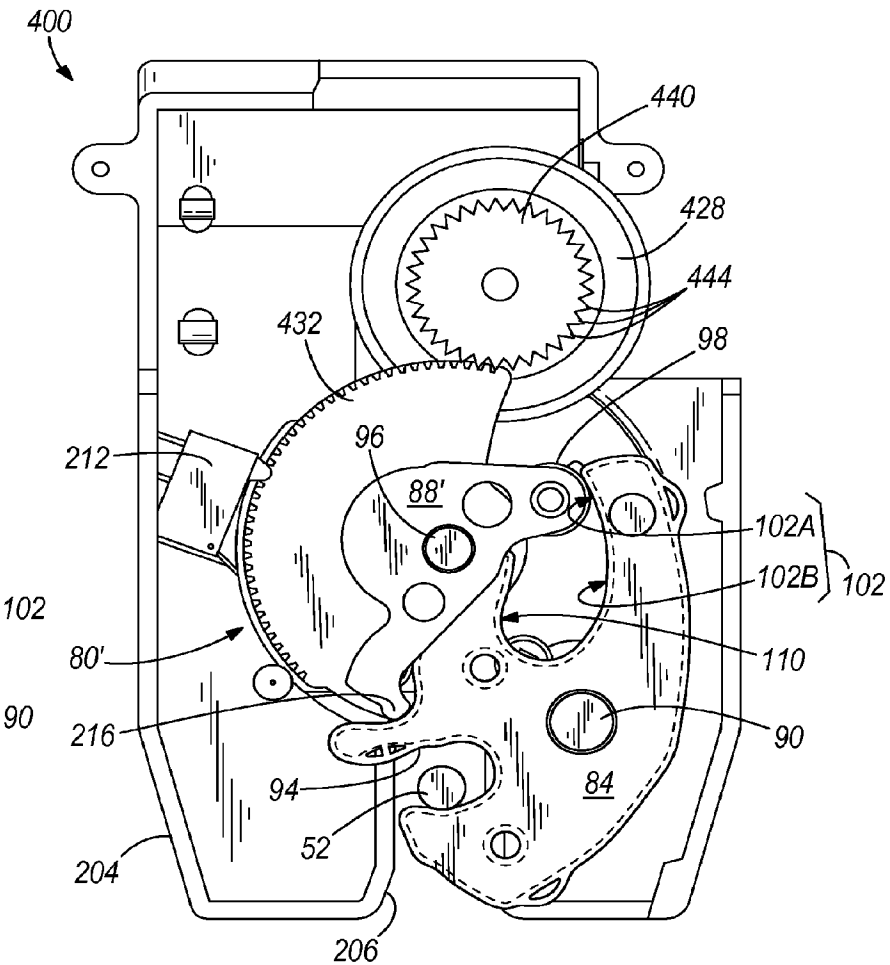
FIG. 13B is a front view of the residual magnet latch assembly of FIG. 13A, shown in a latched state.
Figure 13A:
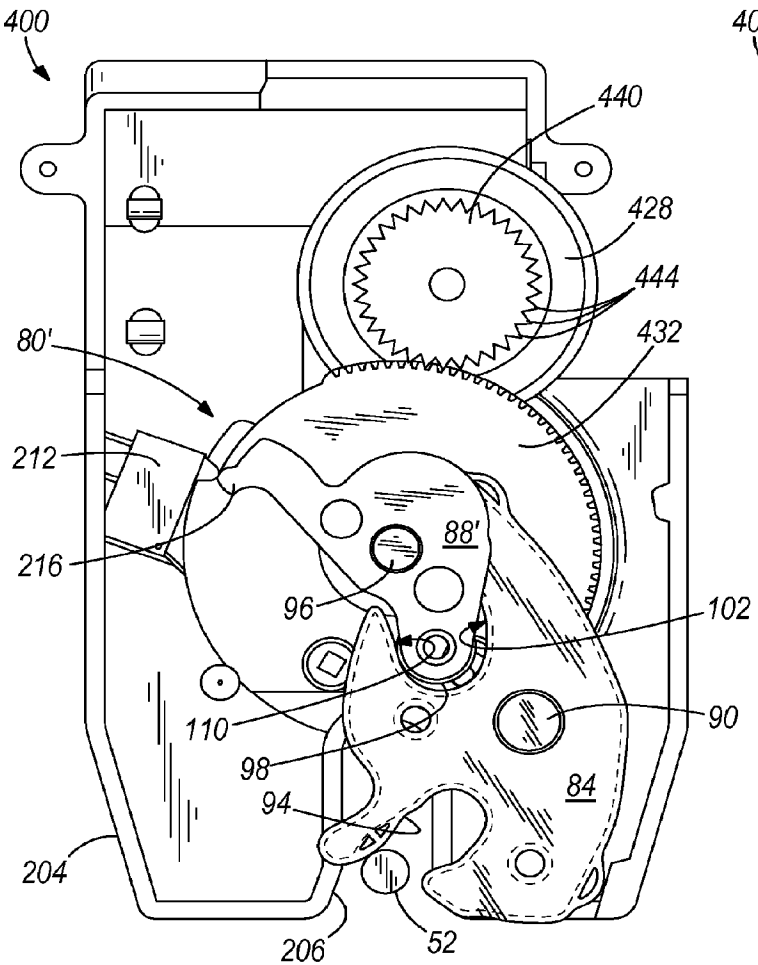
FIG. 13A is a front view of a residual magnet latch assembly utilizing the latch of FIG. 2, the residual magnet latch assembly being shown in an unlatched state.

FIGS. 13A and 13B illustrate another power latch assembly 400 according to another embodiment of the present invention. The power latch assembly 400 of FIGS. 13A and 13B is structurally and functionally similar to the earlier-described power latch assemblies 200, 300 in many respects and thus, a duplicative description of the common features is not provided. Reference is hereby made to the description above in connection with FIGS. 6-12 for a more complete understanding of the features, elements, and operation (and possible alternatives to such features, elements, and operation) of the embodiment of FIGS. 13A and 13B. Common reference numbers are used where appropriate.

The power latch assembly 400 of FIGS. 13A and 13B includes a modified latch 80' that is identical in most respects to the latch 80 of FIG. 2. Where the modified latch 80' differs from the above-described latch 80 is that the pawl 88' is modified to include an integral gear portion 432. Interaction between the pawl 88' and the catch 84 (i.e., the synchronous movement between latched and unlatched positions as described above) is the same as that between the pawl 88 and the catch 84 of FIG. 2, also shown and described as part of the latch assemblies 200, 300. However, the use of a residual magnet actuator 428 allows (among other things) the elimination of the driver 220 present in the latch assemblies 200, 300.

The residual magnet actuator 428 includes an output member, shown as a gear wheel 440 by way of example only. The illustrated gear wheel 440 is generally circular, and includes a plurality of teeth 444 that intermesh with a toothed portion 432 of the pawl 88'. Although it may not be required that the gear wheel 440 define a full circle covered with teeth 444, the gear wheel 440 and the pawl 88' are configured to be constantly engaged throughout the full range of motion of the pawl 88' between the latched and unlatched positions. In other embodiments, driving force between the residual magnetic actuator 428 and the pawl 88' can be accomplished by other suitable mechanical connections, such as by a linkage pivotably coupled at one end to an off-center location on the residual magnetic actuator, and pivotably coupled at an opposite end to an off-center location of the pawl 88', or in still other manners.

With continued reference to the illustrated embodiment of FIGS. 13A and 13B, when the latch assembly 400 is in the unlatched position, the portion 216 of the pawl 88' actuates the switch 212. The pawl 88' is driven by the catch 84 out of the unlatched position to the latched position as the striker 52 is manually forced into the groove 94 of the catch 84. As the pawl 88' is driven counterclockwise to the latched position, the toothed portion 432 of the pawl 88' drives the gear wheel 440 of the residual magnet actuator 428 clockwise. "Back-driving" the residual magnet actuator 428 during the latching operation allows energy to be stored in an energy storage device. The energy storage device can be a spring, such as a torsion spring internal to the residual magnet actuator 428, a torsion spring coupled to the pawl 88', an extension, compression, or other type of spring coupled to the residual magnet actuator 428 and/or to the pawl 88', one or more elastic members coupled to the residual magnet actuator 428 and/or to the pawl 88', and the like. The stored energy can be held by temporarily energizing the residual magnet actuator 428, and can later be released to drive the latch 80' to the unlatched state by temporarily energizing the residual magnet actuator 428 again. Energizing the residual magnet actuator 428 to hold the stored energy can be triggered by a controller in response to the sensor 212 sensing movement of the pawl 88' to the latched position. The fundamentals of operation of the residual magnet actuator 428 are discussed in further detail below.

Figure 14:
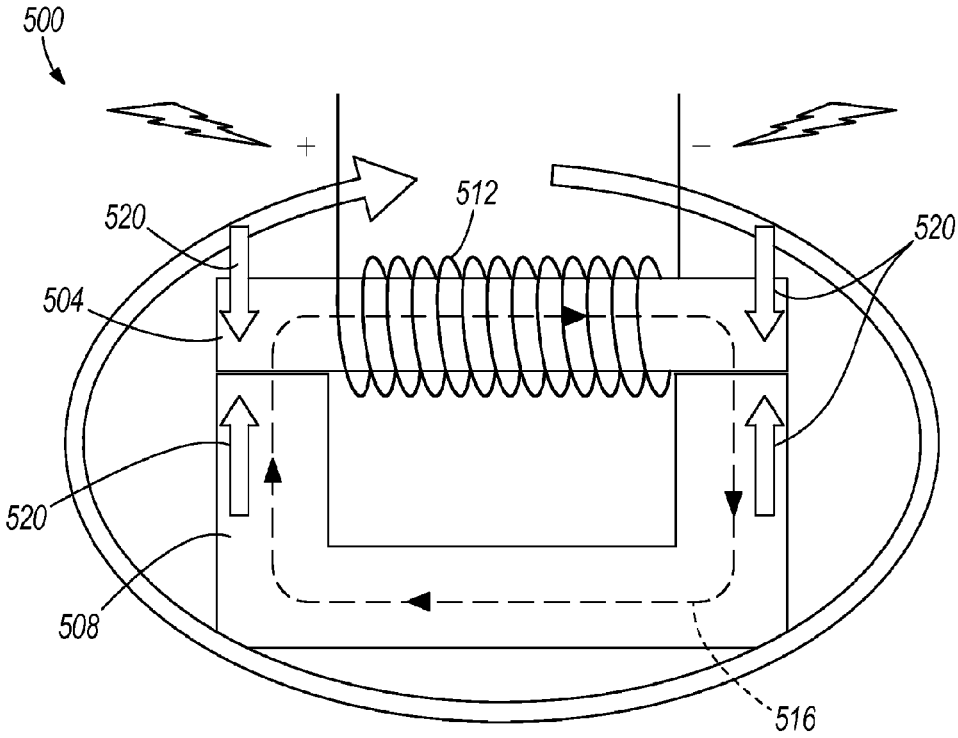
FIGS. 14 and 15 schematically illustrates the operation of a residual magnet.
Figure 15:
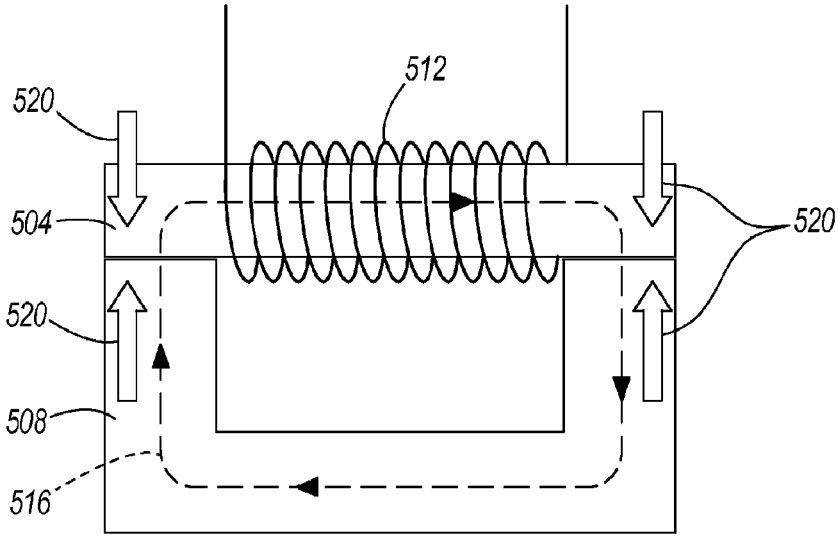

FIGS. 14 and 15 schematically illustrate operation of a residual magnet assembly 500. The residual magnet includes at least two elements constructed of a material capable of retaining a magnetic flux when the elements are moved into contact with one another to provide a closed magnetic flux path. These elements (504, 508 in FIGS. 14 and 15) can have any shape and size capable of performing this function. When current is applied to the electromagnet coil 512 as shown in FIG. 14, a loop-shaped magnetic flux path 516 is established through the elements 504, 508 of the assembly 500, and as the vertical arrows 520 indicate, a magnetic attraction is established therebetween. After the electrical current is stopped as shown in FIG. 15, magnetic flux and the magnetic attraction between the elements 504, 508 are still present. To release the magnetic attraction between these elements 504, 508, a reverse polarity current pulse is applied to the electromagnet coil 512 or the elements 504, 508 are moved away from one another sufficiently to break the closed magnetic flux path. If a reverse polarity current is not applied and if the closed magnetic flux path is not broken, the residual magnetic attraction will remain indefinitely.

There are many benefits of utilizing a residual magnet assembly such as that shown schematically in FIGS. 14 and 15 and described above. The residual magnetic field remains internal to the assembly and does not emit a magnetic attraction to the surrounding environment. Furthermore, operation of a residual magnet is generally not affected by temperature, shock load, electromagnetic interference or external magnetic attack. A simple residual magnet can be used to inhibit various types of motion including separation (e.g., where two surfaces of the elements 504, 508 are pulled away from one another), translational or rotary movement (e.g., where the surfaces are shifted with respect to one another while still being kept facing and/or in contact with one another), and combinations of such movement. Residual magnets are also quiet and fast-operating, are easily scalable for various applications, are not susceptible to manual security attacks or power loss, and generally exhibit a simple design with low part count and minimal moving parts. A residual magnet assembly can also provide an inherent clutch slip feature that eliminates potential of component shear failure, provides constant torque resistance, and reduces system cost.

Further information regarding the residual magnet assemblies, the materials of such assemblies, and the manner of operation of such assemblies is found in U.S. Patent App. Pub. No. 20060219497, the entire contents of which are incorporated herein by reference insofar as they relate to residual magnets, residual magnetic devices and operation of such devices, and residual magnetic materials.

Figure 16:
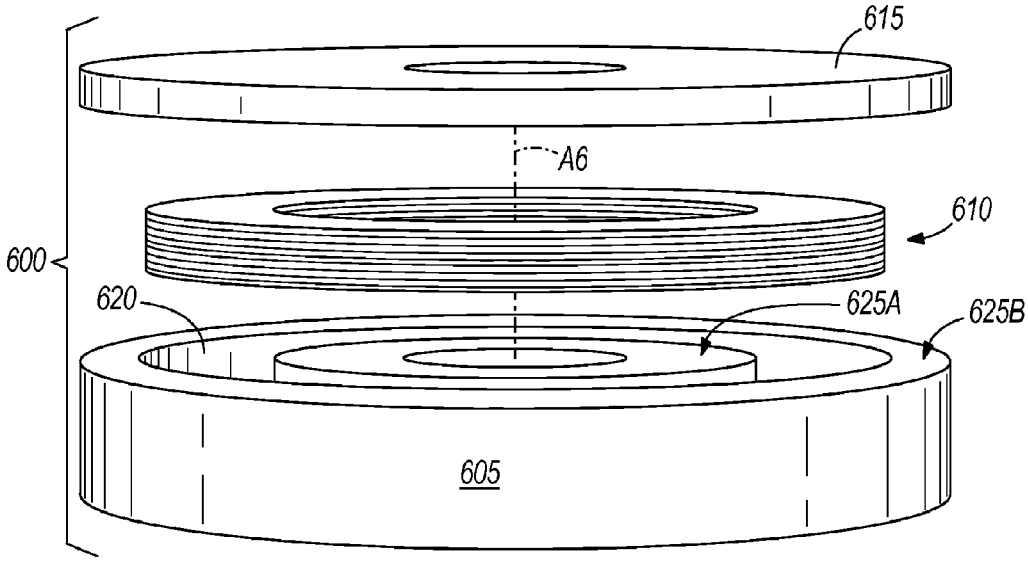
FIG. 16 is an exploded view of a toroidal residual magnet used in the residual magnet latch assembly of FIGS. 13A and 13B.
Figure 17:
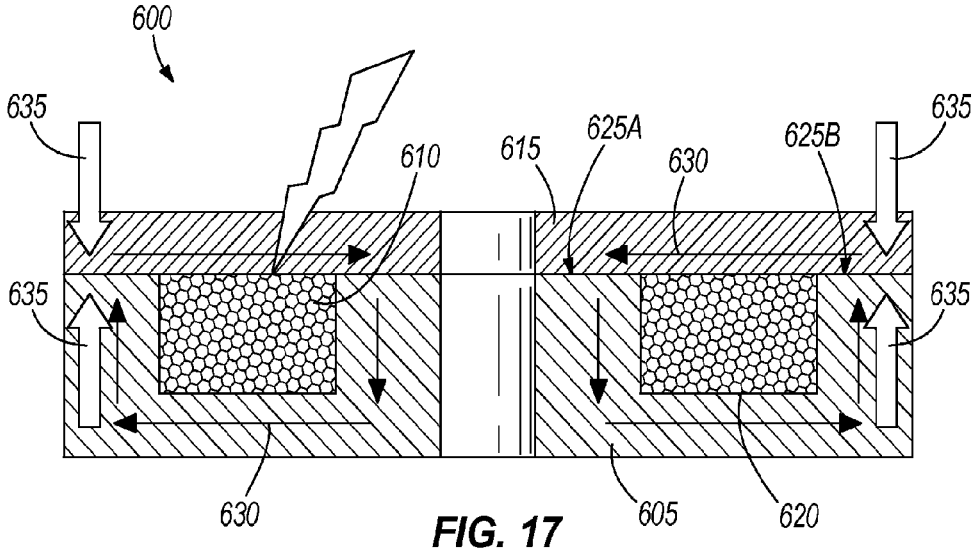
FIG. 17 is a cross-sectional view of the toroidal residual magnet of FIG. 16, shown in a first state.
Figure 18:
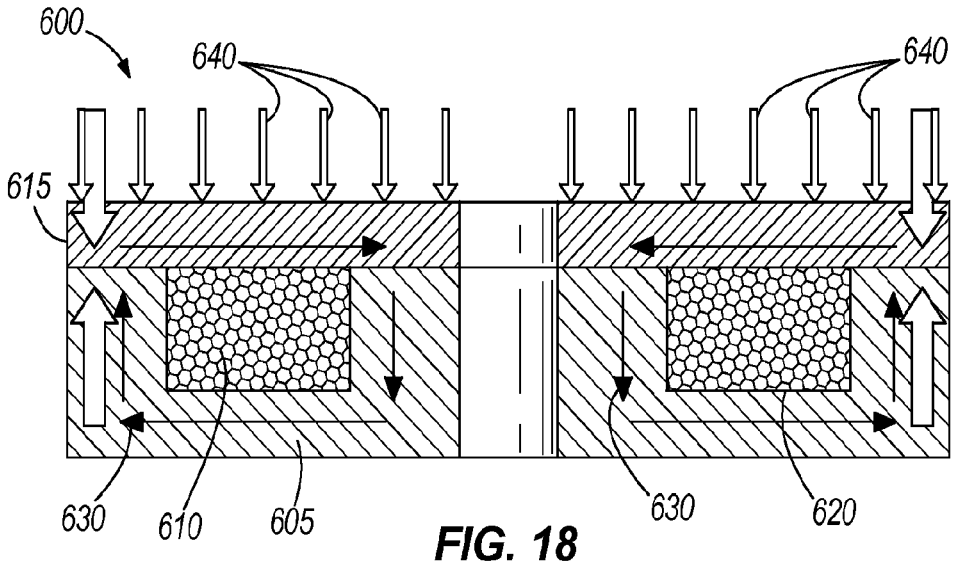
FIG. 18 is a cross-sectional view of the toroidal residual magnet of FIG. 16, shown in a second state.

FIGS. 16-18 illustrate a toroidal residual magnet assembly 600 that functions similarly to the residual magnet 500 schematically illustrated in FIGS. 14 and 15 and that is configured for use in the residual magnet actuator 428 of FIGS. 13A and 13B. The toroidal residual magnet assembly 600 includes a core 605, a coil 610, and an armature 615. The illustrated core 605 is generally circular, and includes a generally circular recess 620 between inner and outer pole faces 625A, 625B. The coil 610 is positioned within the recess 620 in the core 605, and the armature 615 is positioned over the coil 610 so that the armature 615 rests against the pole faces 625A, 625B. Energizing the coil 610 (i.e., flowing electrical current therethrough as shown in FIG. 17) creates magnetic saturation of the assembly. A loop-shaped magnetic flux path is established around the coil 610 at each cross-sectional location, as shown by the magnetic field direction arrows 630 in FIG. 17. As the vertical arrows 635 indicate, a magnetic attraction is established between the core 605 and the armature 615 in a direction parallel to the axis A6 (see FIG. 16) of the toroidal residual magnet 600. After electrical current to the coil 610 is stopped as shown in FIG. 18, residual magnetic flux causes the magnetic attraction between the core 605 and the armature 615 to remain. As shown by the field of arrows 640 in FIG. 18, the magnetic attraction can create a generally uniform pressure distribution across the armature 615 and the pole faces 625A, 625B of the core 605. To release the magnetic attraction between the core 605 and the armature 615, a reverse polarity current pulse is applied to the coil 610, or the armature 615 is physically separated from the core 605. Response time for release by a reverse polarity current is very fast (e.g., about 25 milliseconds). The residual magnet 600 and the corresponding actuator 428 allow not only fast operation, but also very quiet operation as gear and motor noises can be eliminated.

The toroidal residual magnet 600 of FIGS. 16-18 allow movement-inhibiting holding power between the core 605 and the armature 615 to be generated with low electrical power consumption, and to then be maintained via the residual magnetic attraction with no power consumption thereafter. In some embodiments, the magnetic attraction can create a pressure distribution of at least about 0.84 $N/mm^2$ between the armature 615 and core 605. The residual magnetic attraction resists axial pulling apart of the core 605 and the armature 615, and can also resists twisting of one of the core 605 and the armature 615 relative to the other about the axis A6. When used as a residual magnet actuator 428 of FIGS. 13A and 13B, the armature 615 or the core 605 can be coupled to or made integral with the illustrated gear wheel 440. Rotation of the gear wheel 440 with the associated residual magnetic element (e.g., armature 615 or core 605) relative to the other residual magnetic element is allowed freely when the magnetic flux is not present, and is inhibited or prevented when the magnetic flux is present. This allows the gear wheel 440 to be driven by the pawl 88' during the latching operation to store potential energy (e.g., in a torsion spring as described above), and then to be locked in place by the magnetic attraction generated by a temporary pulse of electrical current. To effect unlatching and release of the striker 52 from the catch 84, the magnetic flux in the residual magnet 600 of the illustrated embodiment of FIGS. 13A and 13B is canceled by a temporary pulse of electrical current having opposite polarity as the magnetic flux-inducing first pulse. When the magnetic flux is thereby canceled, the potential energy is released to move the gear wheel 440 and drive the pawl 88' and the catch 84 to their respective unlatched positions.

Figure 19:
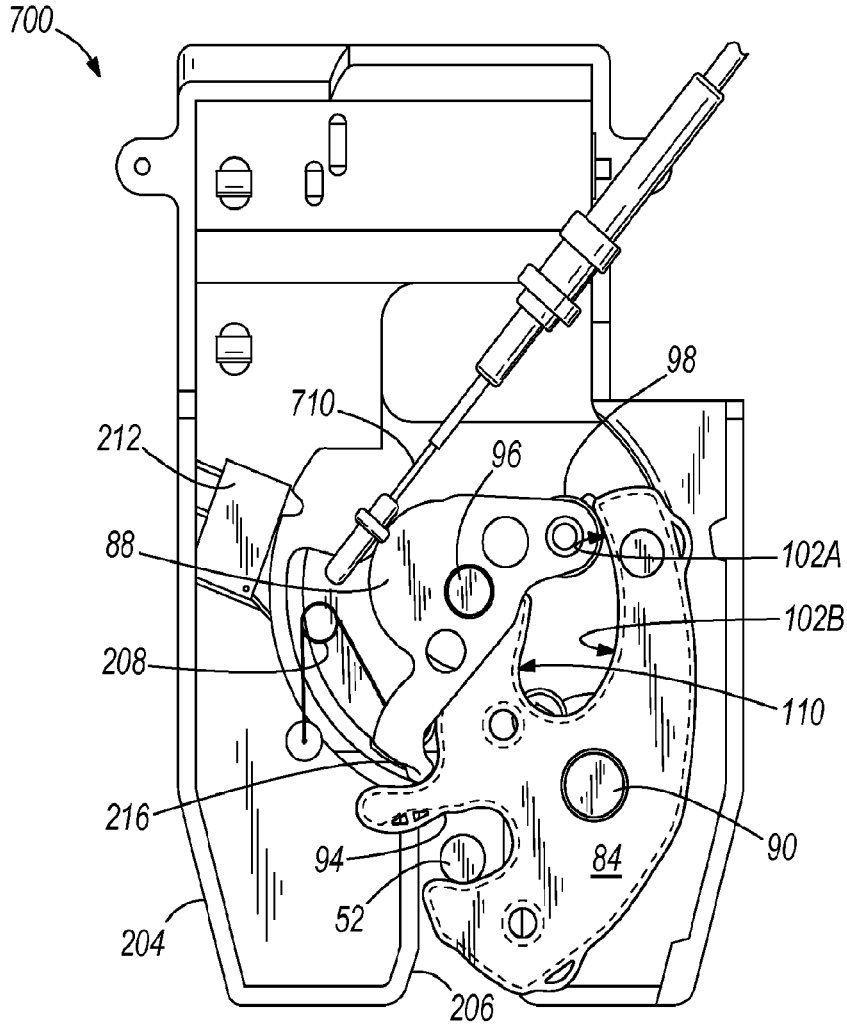
FIG. 19 is a front view of a manual latch assembly utilizing the latch of FIG. 2, the manual latch assembly being illustrated in a latched state.

FIG. 19 illustrates a manual latch assembly 700 including the latch 80 of FIG. 2. Except as described herein, the manual latch assembly 700 of FIG. 19 is structurally and functionally similar to the power latch assemblies 200, 300, 400 of FIGS. 6-13B and thus, a duplicative description of the common features is not provided. Reference is hereby made to the description above in connection with FIGS. 6-13B for a more complete understanding of the features, elements, and operation (and possible alternatives to such features, elements, and operation) of the embodiment of FIG. 19. Common reference numbers are used where appropriate.

In the embodiment of FIG. 19, a manual release actuator 710 is coupled to the pawl 88 at a distance from the pin 96 on which the pawl 88 is rotatably mounted. In the illustrated embodiment, the manual release actuator 710 is a Bowden cable that can be pulled from an end remote from the pawl 88 to rotate the pawl 88 out of the latched position (FIG. 19) toward the unlatched position. From the latched position, pulling the manual release actuator 710 generates a torque on the pawl 88, which rotates clockwise about the pin 96. The torque is sufficient to overcome the bias of the over-center spring 208 and to move the roller 98 from the first portion 102A to the second portion 102B of the cam surface 102. Upon further pulling of the manual release actuator 710, the crossover point of the over-center spring 208 is crossed, and the spring 208 then biases the pawl 88 to the unlatched position. Movement of the pawl 88 to the unlatched position causes a corresponding movement (i.e., counterclockwise rotation about pin 90) of the catch 84 to its unlatched position since the catch 84 and the pawl 88 are configured for synchronous movement as described above. Once unlatched, the manual release actuator 710 can be released, and the latch 80 will be held in the unlatched state by the over-center spring 208. Latching can occur manually by action of the striker 52 on the catch 84, and with the aid of the over-center spring 208, as described above. While the above-described power latch assemblies 200, 300, 400 illustrate many features and benefits of the latch 80, the manual latch assembly 700 of FIG. 19 illustrates that the usefulness of the latch 80 is not limited to such power latch assemblies.

Figure 20A:
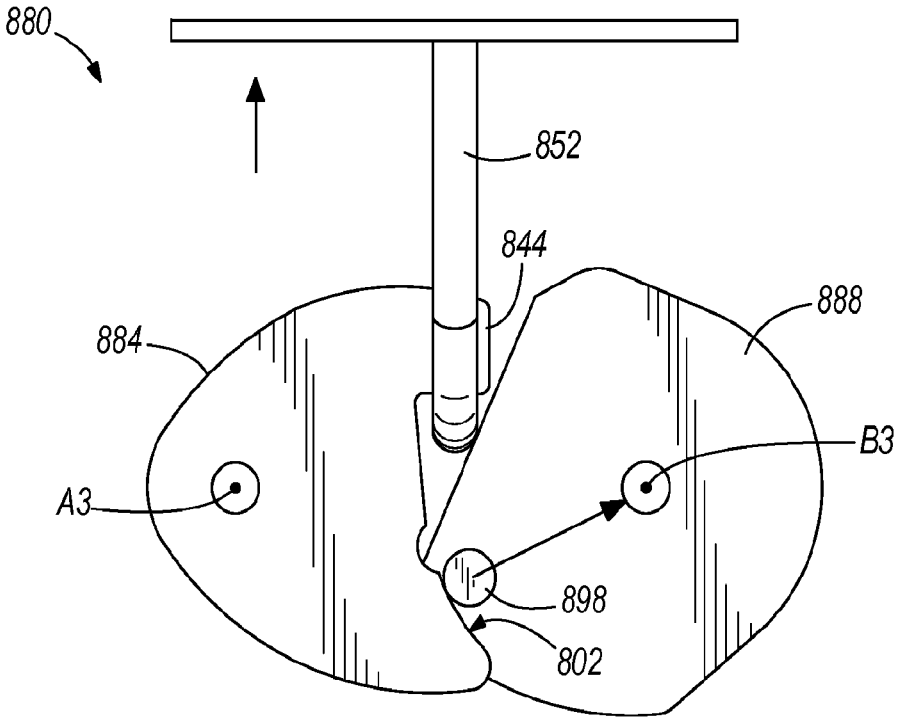
FIGS. 20A and 20B illustrate an alternate latch substitutable for the latch of FIG. 2 in the various latch assemblies disclosed herein.
Figure 20B:
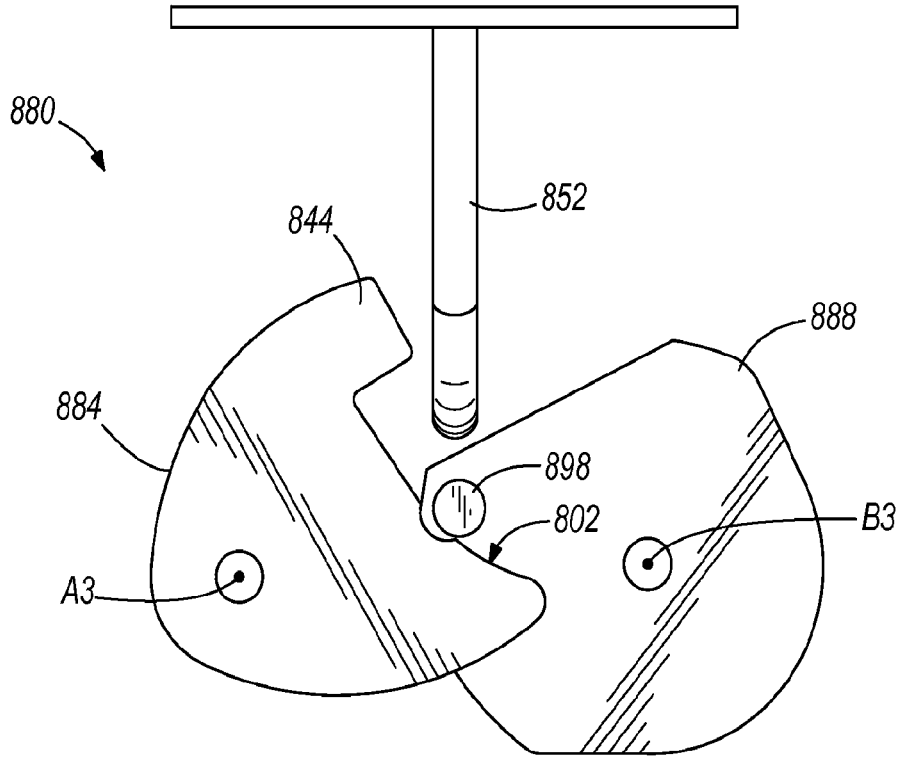

FIGS. 20A and 20B illustrate another latch 880 that is similar in many respects to the latch 80 of FIG. 2. The latch 880 is illustrated in a closed latched state in FIG. 20A and an open unlatched state in FIG. 20B. The latch 880 includes a catch 884 rotatable about a first axis A3, and a pawl or reaction plate 888 rotatable about a second axis B3 that can be parallel to the first axis A3. The catch 884 and the pawl 888 are co-drivable. The illustrated catch 884 includes a hook portion 844 that engages a striker 852 in the latched position. Also, the illustrated pawl 888 includes a cam roller 898 that is engageable with a concentric cam surface 802 of the catch 884 (i.e., concentric with respect to the axis of rotation B3 of the pawl 888). With the latch 880 in the latched state of FIG. 20A, the load applied to the cam roller 898 from the cam surface 802 from any force on the catch 884 in the unlatching direction is generally directed toward the axis B3. Thus, similar to the latch 80 of FIG. 2, the pawl 888 is stable, since there are no or very low rotational loads on the pawl 888 to drive it toward the unlatched state. Accordingly, the latch 880 must be released to the latched position (i.e., to release the striker 854 from the hook 844) by applying an external force or torque to the pawl 888 so that the pawl 888 rotates the roller 898 off the concentric cam surface 802.

To release the latch 880 from the latched state of FIG. 20A, the pawl 888 is rotated clockwise about the axis B3 so that the cam roller 898 is removed from the concentric cam surface 802. The catch 884 need not be actuated directly by any outside force or actuator. The external force on the pawl 888 to drive the latch 880 to the unlatched state can be provided by any type of actuator (e.g., a mechanical lever, a spring load, a DC motor, a solenoid, a smart material actuator, etc.). To close the latch 880, the pawl 888 is rotated counterclockwise about the axis B3. The rotation of the pawl 888 may be effected by an actuator, or merely by contact from the striker 852 when the striker 852 is swung into contact with the pawl 888. Movement of the pawl 888 to the latched position drives synchronous movement of the catch 884 to its latched position by way of the cam roller 898 which drives rotation of the catch 884.

The unique engagement between the roller 898 of the pawl 888 and the concentric cam surface 802 of the catch 884 enables the pawl 888 to securely hold the catch 884 in the latched position while also allowing the pawl 888 to be moved to release the catch 884 as desired with the application of only a small force due to the low friction contact. The latch 880 of FIGS. 20A and 20B may be substituted for the latch 80 in one or all of the latch assemblies 200, 300, 400, 700 shown in the drawings and described above.

Figure 21:
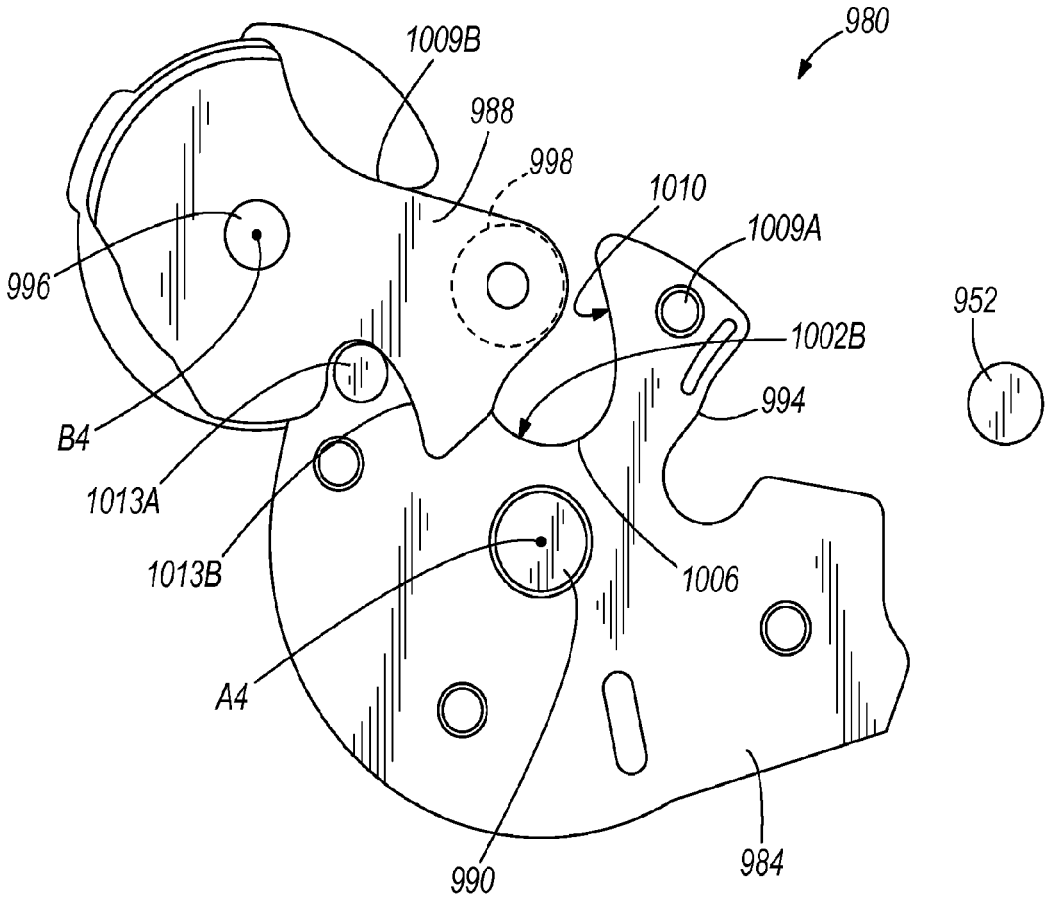
FIG. 21 illustrates a latch according to an embodiment of the present invention, the latch being shown in an unlatched state.
Figure 22:
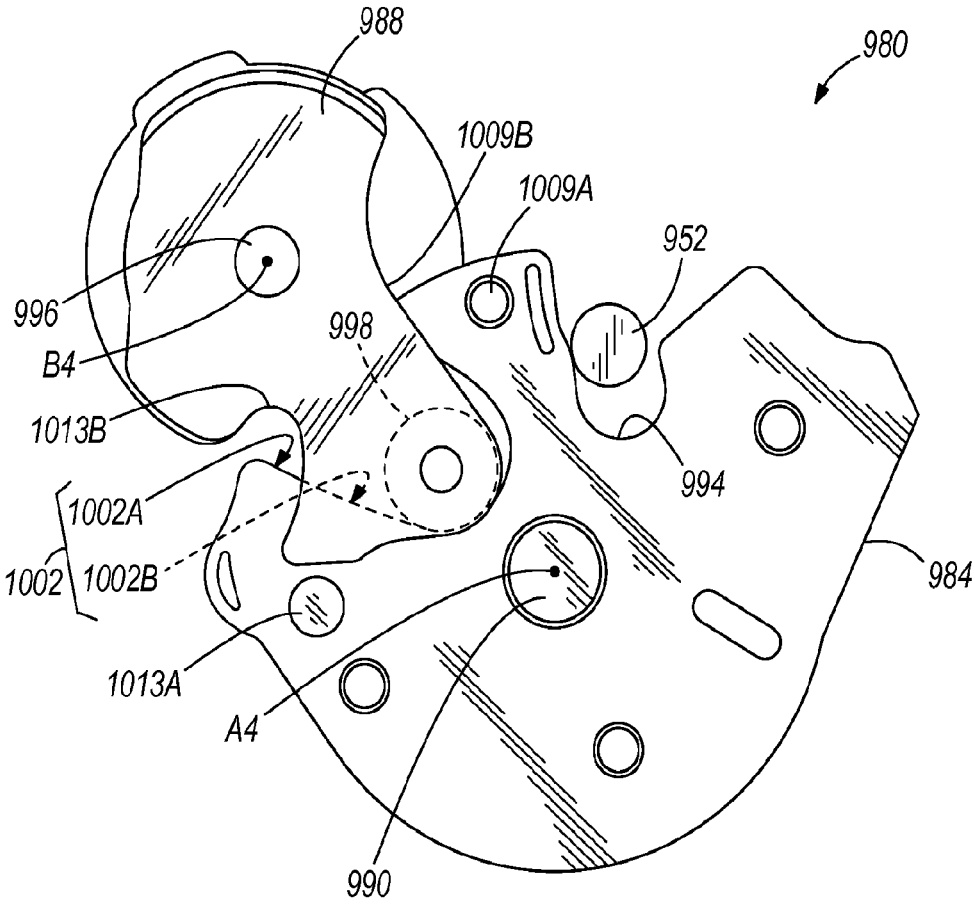
FIG. 22 illustrates the latch of FIG. 21 in a transition state between latched and unlatched states.
Figure 23:
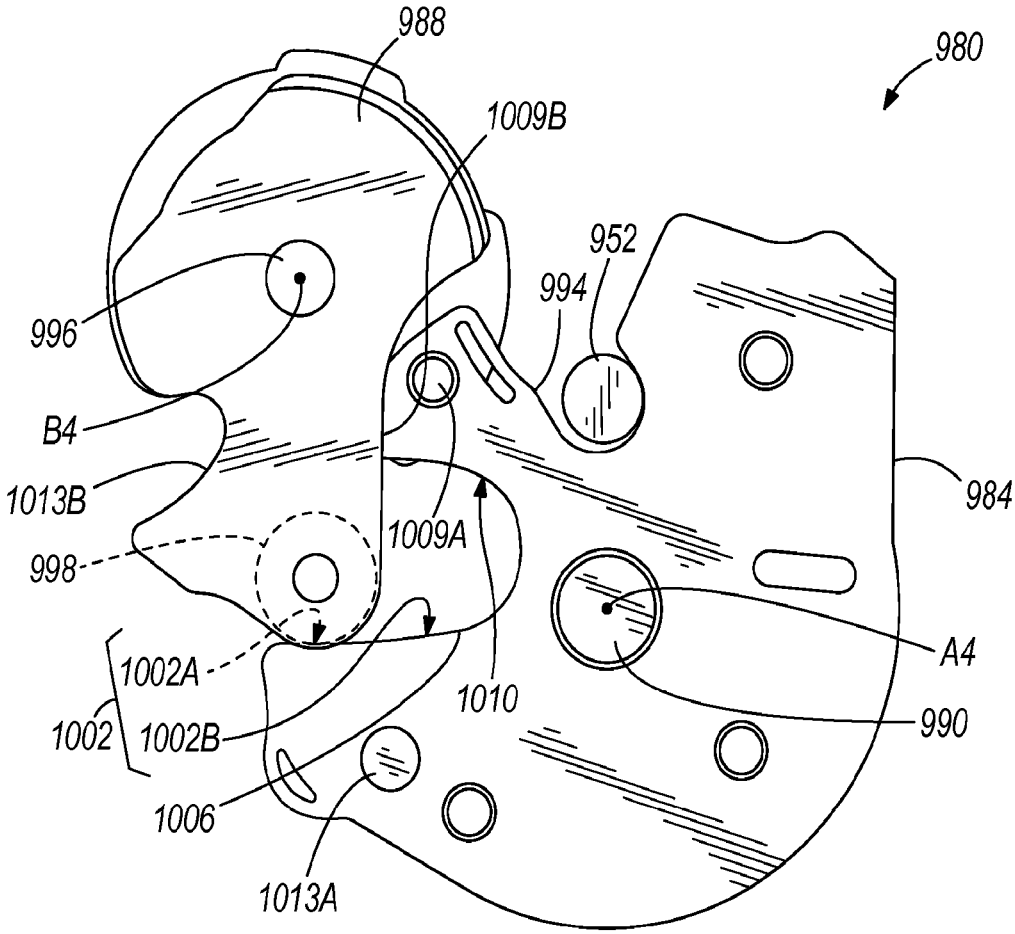
FIG. 23 illustrates the latch of FIG. 21 in the latched state.

FIGS. 21-23 illustrate yet another latch 980. The latch 980 is similar in many structural and functional aspects to the latch 80, and may be substituted into one or all of the latch assemblies 200, 300, 400, 700 shown in the drawings and described above. Where appropriate, reference numbers for the latch 980 are similar to those of the latch 80, incremented by 900. Reference is hereby made to the above description, and the accompanying drawings, for similar characteristics such that the description below is focused primarily on the additional features of the latch 980 illustrated in FIGS. 21-23.

As described with reference to the other latches above, the latch 980 includes a catch 984 and a pawl 988 that are co-drivable. The pawl 988 selectively secures or retains the catch 984 in a latched position (FIG. 23) in which a striker 952 may be held fixed by the catch 984. Rotation of the catch 984 from the unlatched position (FIG. 21) to the latched position (FIG. 23), counterclockwise in the drawings about pin 990 and axis A4, corresponds to rotation of the pawl 988 from an unlatched position to a latched position, clockwise in the drawings about pin 996 and axis B4. In some constructions, a roller 998 of the pawl 988 may move along the cam surface 1002 of the catch 984 during rotation of the catch 984 to the latched position. In some constructions, the pawl 988 may be configured to provide a driving force, alone or in combination with a force applied by the striker 952, to move the catch 984 to the latched position. A first portion 1002A of the cam surface 1002 has a curvature substantially concentric with the pawl axis B4 when the catch 984 is in the latched position. A second portion 1002B of the cam surface 1002 is non-concentric with the pawl axis B4 when the catch 984 is in the latched position, and rather, is shaped so that the pawl 988 may exert a cinching or closing force on the catch 984 as the pawl 988 rotates from the transition position of FIG. 22 to the latched position of FIG. 23.

In order to inhibit the catch 984 from over-rotating in the latching direction, and to ensure that the roller 998 of the pawl 988 remains in contact with the first or "concentric" cam surface portion 1002A, the catch 984 and the pawl 988 are provided with a first set of interference structures. In the illustrated construction, a projection 1009A is formed on the catch 984 and is configured to abut a surface 1009B of the pawl 988 if the catch 984 is rotated (further counterclockwise as viewed in the drawings) past the latched position of FIG. 23.

To release the latch 980, the pawl 988 is rotated about the pawl axis B4 (counterclockwise in the drawings) so that the pawl roller 998 moves off of the first cam surface portion 1002A to the second cam surface portion 1002B of the catch 984. From this point, the pawl 988 does not resist movement of the catch 984 to the unlatched position of FIG. 21, and may assist in driving the catch 984 to the unlatched position. For example, the pawl 988, and particularly the pawl roller 998 in the illustrated construction, may contact a surface 1010 of the catch 984 that is adjacent the cam surface 1002 to apply a force to the catch 984 in the unlatching direction. The unlatching force may be present on the pawl 988 by a powered actuator or by a passive energy-storage device, such as a spring.

When the catch 984 and the pawl 988 reach the unlatched positions of FIG. 21, the pawl 988 is removed from contact with the surfaces (1002, 1010) that make up the pawl-receiving recess or groove 1006. However, in the illustrated construction, another separate physical interface is established between the catch 984 and the pawl 988 in the form of a projection 1013A on the catch 984 and a corresponding recess or groove 1013B of the pawl 988. It should be appreciated that the male/female configuration and the type of structures making up the interface are not necessarily limiting and may be varied in alternate constructions. The interface between the catch 984 and the pawl 988 formed by the projection 1013A and the groove 1013B may be used wholly or in combination with other limiting structures to control the orientation of the catch 984 and/or the pawl 988 when unlatched. However, the interface further enables a driving engagement between the catch 984 and the pawl 988. Thus, when the catch 984 is rotated from the unlatched position of FIG. 21 toward the latched position by contact with the striker 952, the rotation of the catch 984 about the axis A4 drives corresponding rotation of the pawl 988 about the pawl axis B4 toward its latched position. After a predetermined range of travel with the catch 984 driving the pawl 988, the pawl 988 is received back into the groove 1006 of the catch 984, and ultimately the roller 998 re-engages the cam surface 1002 for driving the catch 984 to the latched position.

As described above with reference to other latch assembly constructions, energy applied during a latching event may be stored as the pawl 988 is driven from the unlatched position to the latched position. The energy stored may later be released upon the pawl 988 to release the pawl 988 and the catch 984 to their respective unlatched positions. Although the pawl 988 is stable in its latched position (FIG. 23) and resistant to being backward-driven by the catch 984, the release energy required to release the pawl 988 from the latched position is very low as the roller 998 must simply be moved off of the concentric cam surface 1002A.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, in each of the illustrated embodiments described and illustrated herein, a roller 98, 898, 998 is carried by the pawl 88, 888, 988 and contacts various surfaces of the catch 84, 884, 984 including cam surfaces 102, 110, 802, 1002, 1010. Although the rolling and camming contact is highly desirable to reduce friction between the pawl 88, 888, 988 and the catch 84, 884, 984, in some embodiments the roller 98, 898, 998 can be eliminated to simplify construction and assembly of the latch while still permitting proper functioning of the latch. In such embodiments, other manners of reducing friction between the pawl 88, 888, 988 and the catch 84, 884, 984 can instead be utilized, such as by constructing part or all of the pawl 88, 888, 988 and/or the catch 84, 884, 984 from low-friction material, or by incorporating one or more low-friction elements at the interface between the pawl 88, 888, 988 and the catch 84, 884, 984 (e.g., separate elements attached to the pawl 88, 888, 988 or the catch 84, 884, 984).

Furthermore, it will be appreciated by one having ordinary skill in the art that the configuration of the camming components may be reversed while maintaining the operational characteristics described above. For example, the pawl 88, 888, 988 may be formed with cam surfaces (e.g., convexly shaped cam surfaces complementary to the illustrated cam surfaces 102, 110, 802, 1002, 1010) and the catch 84, 884, 984 may be provided with a follower structure (e.g., a roller similar to pawl roller 98, 898, 998) movable along such cam surfaces.

The invention claimed is:

1. A latch comprising:

a catch pivotable about a first axis between a latched position for retaining a striker and an unlatched position for releasing the striker, the catch having a cam surface; and a pawl pivotable about a second axis and engageable with the cam surface of the catch, the pawl securing the catch in the latched position by resting on a first portion of the cam surface, a curvature of which is substantially concentric with the second axis when the catch is in the latched position, the pawl further being movable off of the first portion of the cam surface to release the catch from the latched position;

wherein the catch is drivable toward the latched position by the pawl when the pawl is driven to engage the first portion of the cam surface.

2. The latch of claim 1, wherein the catch is drivable toward the unlatched position by the pawl.

3. The latch of claim 1, wherein the pawl includes a roller in contact with the cam surface.

4. The latch of claim 1, wherein the cam surface includes a second portion adjacent the first portion that is non-concentric with the second axis when the catch is in the latched position.

5. The latch of claim 1, further comprising an actuator coupled with the pawl to drive the pawl to pivot about the second axis, wherein the catch is cinched toward the latched position by operation of the actuator.

6. The latch of claim 1, wherein pivoting of the catch from the unlatched position to the latched position drives the pawl to rotate about the second axis, and the pawl communicates with an energy storage device to store energy.

7. The latch of claim 6, wherein when the energy stored in the energy storage device is releaseable with the catch in the latched position to drive the pawl and in turn drive the catch toward the unlatched state.

8. The latch of claim 6, further comprising a residual magnet coupled to the energy storage device and configured to hold the energy storage device in a stored-energy state.

9. The latch of claim 1, wherein the cam surface of the catch includes a second portion adjacent the first portion, and wherein the pawl maintains contact with the second portion after releasing the catch from the latched position.

10. The latch of claim 1, further comprising an interface between the catch and the pawl, separate from the cam surface, that provides a driving engagement between the catch and the pawl when the catch is in the unlatched position.

11. A latch comprising:

a catch pivotable about a first axis between a latched position for retaining a striker and an unlatched position for releasing the striker, the catch including a cam surface; and a pawl pivotable about a second axis and engageable with the cam surface of the catch, the pawl securing the catch in the latched position by resting on a first portion of the cam surface, a curvature of which is substantially concentric with the second axis when the catch is in the latched position, the pawl further being movable off of the first portion of the cam surface to release the catch from the latched position;

wherein the catch and the pawl are co-drivable, such that the pawl is drivable by the catch to rotate about the second axis when the catch rotates about the first axis, and the catch is drivable by the pawl to rotate about the first axis when the pawl rotates about the second axis.

12. The latch of claim 11, wherein the cam surface includes a second portion adjacent the first portion that is non-concentric with the second axis when the catch is in the latched position, movement of the pawl along the second portion of the cam surface toward the first portion of the cam surface providing a latch-cinching force to the catch.

13. The latch of claim 12, wherein the catch is drivable toward the unlatched position by the pawl.

14. The latch of claim 11, wherein the pawl includes a roller in contact with the cam surface.

15. The latch of claim 11, further comprising an actuator coupled with the pawl to drive the pawl to pivot about the second axis, wherein the catch is cinched into the latched position by operation of the actuator.

16. The latch of claim 11, wherein pivoting of the catch from the unlatched position to the latched position drives the pawl to rotate about the second axis, and the pawl communicates with an energy storage device to store energy.

17. The latch of claim 16, wherein when the energy stored in the energy storage device is releaseable with the catch in the latched position to drives the pawl and in turn drive the catch to the unlatched state.

18. The latch of claim 15, further comprising a residual magnet coupled to the energy storage device and configured to hold the energy storage device in a stored-energy state.

19. The latch of claim 11, wherein the cam surface of the catch includes a second portion adjacent the first portion, and wherein the pawl maintains contact with the second portion after releasing the catch from the latched position.

20. The latch of claim 11, further comprising an interface between the catch and the pawl, separate from the cam surface, that provides a driving engagement between the catch and the pawl when the catch is in the unlatched position.

21. A latch comprising:

a catch pivotable about a first axis between a latched position for retaining a striker and an unlatched position for releasing the striker;

a pawl pivotable about a second axis between a first position in which the pawl retains the catch in the latched position, and a second position in which the pawl releases the catch from the latched position; and an energy storage device coupled to the pawl, wherein pivoting of the catch toward the latched position generates pivoting of the pawl toward the first position and storage of energy in the energy storage device, and wherein the pawl is drivable from the first position toward the second position by release of the energy stored in the energy storage device to the pawl.

22. The latch of claim 21, wherein the catch is drivable to the unlatched position by release of the energy stored in the energy storage device is released to the pawl via movement of the pawl from the first position to the second position.

23. The latch of claim 21, wherein the catch includes a cam surface, a first portion of which has a curvature substantially concentric with the second axis when the catch is in the latched position, the pawl securing the catch in the latched position by resting on the first portion of the cam surface, the pawl further being movable off of the first portion of the cam surface to release the catch from the latched position.

24. The latch of claim 23, wherein the cam surface includes a second portion adjacent the first portion that is non-concentric with the second axis when the catch is in the latched position, movement of the pawl along the second portion of the cam surface toward the first portion of the cam surface providing a latch-cinching force to the catch.

25. The latch of claim 23, wherein the pawl includes a roller in contact with the cam surface.

26. The latch of claim 23, wherein the cam surface of the catch includes a second portion adjacent the first portion, and wherein the pawl maintains contact with the second portion after releasing the catch from the latched position.

27. The latch of claim 21, further comprising an actuator coupled with the pawl to drive the pawl to pivot about the second axis, wherein the catch is cinched into the latched position by operation of the actuator.

28. The latch of claim 21, further comprising a residual magnet coupled to the energy storage device and configured to hold the energy storage device in a stored-energy state.

* * * * *